US012421649B2

(12) United States Patent
Lee et al.

(10) Patent No.: US 12,421,649 B2
(45) Date of Patent: Sep. 23, 2025

(54) CLOTHES CARE APPARATUS

(71) Applicant: SAMSUNG ELECTRONICS CO., LTD., Suwon-si (KR)

(72) Inventors: Geonhee Lee, Suwon-si (KR); Yongsoo Kyong, Suwon-si (KR); Namsoo Park, Suwon-si (KR); Wangi Park, Suwon-si (KR); Jaemin Park, Suwon-si (KR); Junwon Seo, Suwon-si (KR); Hojin Shin, Suwon-si (KR); Youngkyun Jeong, Suwon-si (KR); Hyungkwen Ham, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 214 days.

(21) Appl. No.: 18/207,542

(22) Filed: Jun. 8, 2023

(65) Prior Publication Data

US 2023/0313436 A1 Oct. 5, 2023

Related U.S. Application Data

(63) Continuation of application No. PCT/KR2021/019552, filed on Dec. 22, 2021.

(30) Foreign Application Priority Data

Feb. 1, 2021 (KR) ..... 10-2021-0014326

(51) Int. Cl.
*D06F 58/12* (2006.01)
*D06F 73/02* (2006.01)
(Continued)

(52) U.S. Cl.
CPC ..... *D06F 58/12* (2013.01); *D06F 73/02* (2013.01); *D06F 57/00* (2013.01); *D06F 58/206* (2013.01)

(58) Field of Classification Search
CPC ..... D06F 57/00; D06F 58/12; D06F 73/02; D06F 58/206
See application file for complete search history.

(56) References Cited

U.S. PATENT DOCUMENTS 1,602,315 A * 10/1926 Wood ..... D06F 58/10 34/233
3,166,923 A * 1/1965 Zacks ..... D06F 43/06 68/3 R
(Continued)

FOREIGN PATENT DOCUMENTS

CN 109487518 A 3/2019
CN 112160128 A 1/2021
(Continued)

OTHER PUBLICATIONS

International Search Report dated Apr. 19, 2022 in International Patent Application No. PCT/KR2021/019552.
(Continued)

*Primary Examiner* — Benjamin L Osterhout
(74) *Attorney, Agent, or Firm* — STAAS & HALSEY LLP

(57) ABSTRACT

A clothes care apparatus comprises: a care chamber; a support bar to extend along an extending direction; a holding member which includes a hanging portion, at upper end of the holding member, supportable by the support bar; a support portion arrangeable such that while an upper end of the hanging portion is hung on the support portion the hanging portion is supported by the support bar; a slider to perform a linear reciprocating motion; and a swing hook, to grip a lower end of the hanging portion, and moveable while the slider performs the linear reciprocating motion. The upper end of the hanging portion is supported at one point by the support portion while the lower end of the hanging portion reciprocates as the swing hook moves while the
(Continued)

slider performs the linear reciprocating motion, thereby the hanging portion is to shake the clothes hung on the holding member.

15 Claims, 27 Drawing Sheets

(51) Int. Cl.
*D06F 57/00* (2006.01)
*D06F 58/20* (2006.01)

(56) References Cited

U.S. PATENT DOCUMENTS 3,644,085 A * 2/1972 Beeley ..... D06F 73/02 8/150
3,696,523 A * 10/1972 Beeley ..... D06F 73/02 223/51
3,732,628 A * 5/1973 Blevens ..... D06F 73/02 34/470
3,739,496 A * 6/1973 Buckley ..... D06F 73/02 312/271
3,861,179 A * 1/1975 Orchard ..... D06F 73/02 68/6
3,899,108 A * 8/1975 Frauendorf ..... D06F 73/02 223/51
4,304,053 A * 12/1981 Kellerhals ..... D06F 73/02 34/225
4,625,432 A * 12/1986 Baltes ..... D06F 58/10 34/233
5,094,020 A * 3/1992 Wingfield ..... D06F 73/02 223/51
7,103,996 B2 9/2006 Hapke
8,296,967 B2 * 10/2012 Kim ..... D06F 58/12 68/5 R
8,484,868 B2 * 7/2013 Kim ..... D06F 58/12 211/124
8,707,591 B2 * 4/2014 Moon ..... D06F 73/02 38/14
9,010,158 B2 4/2015 Yoo et al.
9,074,313 B2 * 7/2015 Kim ..... D06F 58/10
9,353,473 B2 5/2016 Park et al.
9,359,710 B2 * 6/2016 Lee ..... D06F 58/12
10,145,059 B2 12/2018 Kim
11,015,283 B2 * 5/2021 Park ..... D06F 58/10
11,414,810 B2 * 8/2022 Kim ..... D06F 69/00
2005/0035076 A1 * 2/2005 Schober ..... A47B 61/003 211/123
2005/0115120 A1 * 6/2005 Cevik ..... D06F 73/02 38/14
2006/0037209 A1 * 2/2006 Johnson ..... D06F 73/02 34/90
2006/0101867 A1 * 5/2006 Kleker ..... D06F 18/00 68/5 R
2009/0235464 A1 * 9/2009 Cassidy ..... D06F 17/04 68/28
2010/0180645 A1 * 7/2010 Kim ..... D06F 73/02 68/5 C
2022/0074122 A1 * 3/2022 Jang ..... D06F 58/24
2022/0074123 A1 * 3/2022 Jang ..... D06F 58/24

FOREIGN PATENT DOCUMENTS

CN 112190007 A 1/2021
KR 10-0929715 12/2009
KR 10-1155002 6/2012
KR 10-1457594 11/2014
KR 10-1498625 3/2015
KR 10-1600788 3/2016
KR 10-2017-0137503 12/2017
KR 10-1859958 5/2018
KR 10-1954032 3/2019
KR 20-0490152 10/2019
KR 10-2020-0128984 11/2020
KR 10-2199468 1/2021

OTHER PUBLICATIONS

PCT/ISA/237 dated Apr. 19, 2022 in International Patent Application No. PCT/KR2021/019552.

* cited by examiner

CLOTHES CARE APPARATUS

CROSS-REFERENCE TO RELATED APPLICATION

This application is a continuation application, under 35 U.S.C. § 111(a), of international application No. PCT/KR2021/019552, filed on Dec. 22, 2021, which claims priority under 35 U. S. C. § 119 to Korean Patent Application No. 10-2021-0014326, filed Feb. 1, 2021, the disclosures of which are incorporated herein by reference in their entirety.

BACKGROUND

Field

The present disclosure relates to a clothes care apparatus, and more particularly, to a clothes care apparatus capable of fixing clothes.

Discussion of Related Art

A clothes care apparatus is an apparatus that performs clothes care, such as drying wet clothes, removing dust attached to clothes or an odor from clothes, and reducing wrinkles on clothes.

The clothes care apparatus may include a clothes care chamber, which is an accommodation space for accommodating clothes, and a clothes hanger to perform refreshing functions such as removing wrinkles, reducing an odor, and removing static electricity, from clothes.

The clothes hanger may be provided as a structure capable of shaking and vibrating a holding member in a specific direction in the care chamber to shake the clothes held on the holding member.

SUMMARY

In accordance with one aspect, a clothes care apparatus according to the spirit of the present invention includes: a care chamber to accommodate clothes; a support bar to extend along an extending direction inside the care chamber; a holding member on which the clothes are to be hung, the holding member including a hanging portion, at an upper end of the holding member, that is supportable by the support bar; a support portion arrangeable relative to the support bar such that while an upper end of the hanging portion is hung on the support portion the hanging portion is supported by the support bar; a slider to perform a linear reciprocating motion; and a swing hook, to grip a lower end of the hanging portion, and coupleable to the slider such that while the swing hook is coupled to the slider, the swing hook is moveable while the slider performs the linear reciprocating motion, wherein the upper end of the hanging portion is supported at one point by the support portion while the lower end of the hanging portion reciprocates as the swing hook moves while the slider performs the linear reciprocating motion, thereby the hanging portion is to shake the clothes hung on the holding member.

The slider may perform the linear reciprocating motion along a first direction, the swing hook may include a pair of pressing parts extending along a second direction perpendicular to the extending direction in which the support bar extends, and the lower end of the hanging portion may be between the pair of pressing parts of the swing hook.

The slider may be in a bar shape extending parallel with a first direction and performs the linear reciprocating motion parallel to the first direction, and the slider may include an interlocking slit, through the slider, the interlocking slit being along an extending direction formed parallel to a third direction perpendicular to the first direction in which the slider performs the linear reciprocating motion.

The clothes care apparatus may further include a motor configured to provide a driving force to the slider and an interlocking portion connectable to a rotation axis of the motor to rotate, the interlocking portion may include an interlocking protrusion formed at a position spaced apart from a rotation center of the interlocking portion, and the interlocking protrusion may be insertable into the interlocking slit to convert a rotational motion of the motor into the linear reciprocating motion of the slider.

The clothes care apparatus may further include a sliding base coupleable to the care chamber and including a slider guide to support both ends of an edge of the slider so that the slider performs the linear reciprocating motion along the first direction.

The clothes care apparatus may further include a sliding base, coupleable to the care chamber, the sliding base including a first surface on which the slider is to be seated and a second surface that is positioned opposite to the first surface and to which the motor is coupleable, and the sliding base may include a slider guide protruding from the first surface and to support both ends of an edge of the slider so that the slider performs the linear reciprocating motion along the first direction and an interlocking hole in which the interlocking portion is rotatably seated, the interlocking hole being through the sliding base so that the first surface and the second surface are connected.

The hanging portion may be provided in a hook shape, the lower end of the hanging portion may extend from the upper end of the holding member, the upper end of the hanging portion may be positionable at an upper portion of the hook shape, and the support portion may include a seating part by which the upper end of the hanging portion is supported and limiting parts disposed at both ends of the seating part and provided to limit movement of the upper end of the hanging portion in the extending direction of the support bar.

A plurality of swing hooks may be provided, the plurality of swing hooks may be provided to be coupleable to the slider at regular intervals, and a plurality of support portions may be provided to correspond to the plurality of swing hooks.

The slider may perform the linear reciprocating motion along a first direction which may be parallel to the extending direction of the support bar.

The extending direction of the support bar and the second direction may are perpendicular to each other.

In accordance with another aspect, a clothes care apparatus according to the spirit of the present invention includes: a care chamber to accommodate clothes; a support bar to extend along an extending direction inside the care chamber; a holding member on which the clothes are to be hung, the holding member including a hanging portion, at an upper end of the holding member, that is supportable by the support bar; a support portion arrangeable relative to the support bar such that while an upper end of the hanging portion is hung on the support portion the hanging portion is supported by the support bar; a slider to perform a linear reciprocating motion; a swing hook, to grip a lower end of the hanging portion, coupleable to the slider such that while the swing hook is coupled to the slider, the swing hook is moveable while the slider performs the linear reciprocating motion; and a cover link, which is rotatable, provided on a sliding base supporting the slider, wherein the swing hook is selectively connectable to the slider according to a rotation direction of the cover link.

The slider performs the linear reciprocating motion along a first direction, and the swing hook may include a pair of pressing parts, extending along a second direction perpendicular to the extending direction in which the support bar extends, the lower end of the hanging portion being between the pair of pressing parts, and a coupling protrusion protruding in an opposite direction to the second direction, and the slider may include a coupling groove formed to correspond to the coupling protrusion.

The swing hook may further include a guide chamber formed in a body of the swing hook and into which the coupling protrusion is slidably inserted and a guide spring disposed in the guide chamber to press the coupling protrusion in the opposite direction to the second direction.

The cover link may include: a link body; a pair of link axial protrusions supportable by the sliding base, positioned on a rotation axis of the cover link, and protruding from both sides of the link body; and a link rod between the pair of link axial protrusions, spaced apart from the rotation axis of the cover link, and extending in parallel with the rotation axis of the cover link, the swing hook may include a link slit through the swing hook, and an extending direction of the link slit is perpendicular to an extending direction of the link rod, and the link rod may be insertable into the link slit to selectively connect the swing hook to the slider along the second direction perpendicular the first direction according to the rotation direction of the cover link.

The cover link may further include a pair of swing springs surrounding the link rod and at both ends of the link slit, and the pair of swing springs may press a body of the swing hook so that the swing hook is positioned at a center of the link rod.

The swing hook may include a pair of pressing parts extending along the second direction perpendicular to the extending direction in which the support bar extends, the lower end of the hanging portion may be between the pair of pressing parts of the swing hook, and the hanging portion may be at the upper end of the hanging portion and supportable at one point by the support portion while the lower end of the hanging portion reciprocates as the swing hook moves while the slider performs the linear reciprocating motion and to thereby shake the clothes hung on the holding member.

The slider may be in a bar shape extending in parallel with the first direction and performs the linear reciprocating motion parallel to the first direction, and may include an interlocking slit, through the slider, the interlocking slit being along an extending direction formed parallel to a third direction perpendicular to the first direction in which the slider performs the linear reciprocating motion.

The clothes care apparatus may further include a motor configured to provide a driving force to the slider and an interlocking portion connectable to a rotation axis of the motor to rotate, the interlocking portion may include an interlocking protrusion formed at a position spaced apart from a rotation center of the interlocking portion, and the interlocking protrusion may be insertable into the interlocking slit to convert a rotational motion of the motor into the linear reciprocating motion of the slider.

The cover link may be provided in a first state in which the swing hook is disconnected from the slider by rotating in a first rotation direction and in a second state in which the swing hook is connected to the slider by rotating in a second rotation direction, and may be provided so that the cover link surrounds the support bar and is fixed to the support bar in the second state.

The cover link may include a fixing hook formed at one end of the cover link, and the support bar may include a fixing groove provided to correspond to the fixing hook.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
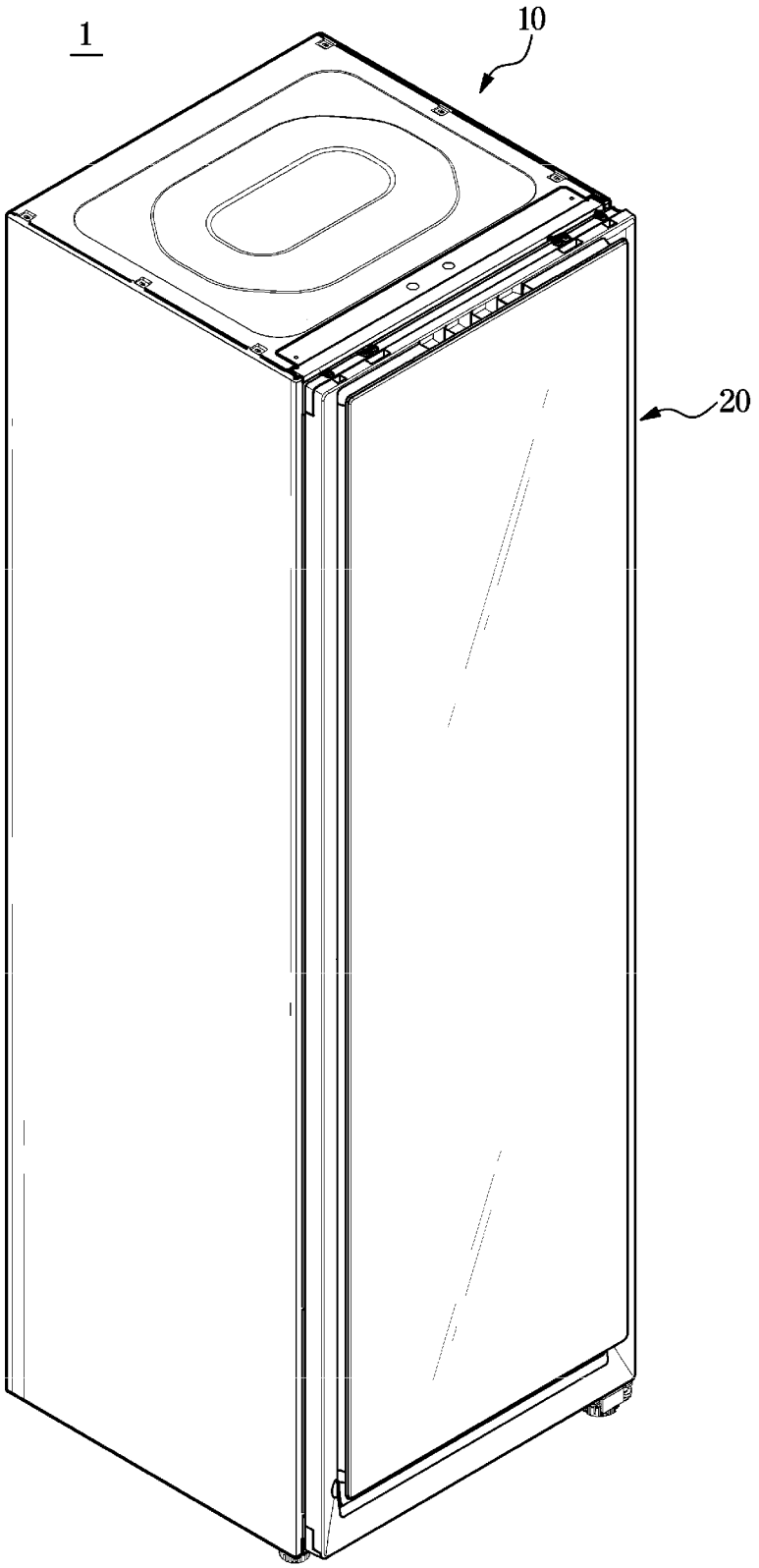
FIG. 1 is a view illustrating a clothes care apparatus according to one embodiment of the present invention.

Embodiments described in the present specification and configurations illustrated in the drawings are just exemplary embodiments of the disclosed invention, and there may be various modifications that may replace embodiments and the drawings of the present specification at the time of filing the present application.

In addition, like reference numerals or marks in drawings of the present specification refer to components or elements that perform substantially the same functions.

In addition, the terms used in the present specification are merely provided to describe embodiments, and are not intended to limit or restrict the present disclosure. Singular forms are intended to include the plural forms, unless the context clearly indicates otherwise. In the present specification, the terms "includes" and/or "including" used herein, merely specify the presence of stated features, integers, steps, operations, elements, components, and/or groups thereof, but do not exclude in advance the possibility of the presence or addition of one or more other features, integers, steps, operations, elements, components, and/or groups thereof.

Terms including ordinal numbers such as first, second, etc. used in the present specification may be used to describe various elements, but it will be appreciated that the elements are not limited to such terms, and these terms are merely used to distinguish one element from another. For example, without departing from the scope of the present invention, a first element could be called a second element, and similarly, a second element could be called a first element. The term "and/or" includes any combination of a plurality of related listed items or any of a plurality of related listed items.

The present invention is directed to providing a clothes care apparatus including a clothes hanger in which a support point and an action point for vibrating a hanging portion of a holding member are separated.

The present invention is directed to providing a clothes care apparatus including a clothes hanger having a structure for selectively vibrating a hanging portion of a holding member.

According to aspects of the present invention, a support point and an action point for vibrating a hanging portion of a holding member are separated, thereby making it possible to maximize the shaking of clothes held on the holding member even with a small amount of kinetic energy.

Furthermore, according to aspects of the present invention, a structure in which a swing hook corresponding to the action point of the hanging portion is selectively connected to a slider is provided to selectively vibrate the hanging portion of the holding member, thereby making it possible to save energy used for clothing equipment.

Meanwhile, the terms used in the description below such as "upper portion," "lower portion," "upper end," and "lower end," "upper surface" and "lower surface" are defined on the basis of FIGS. 2 and 4, and a shape and a position of each element are not limited by the terms.

Hereinafter, embodiments according to the present invention will be described in detail with reference to the accompanying drawings.

Figure 2:
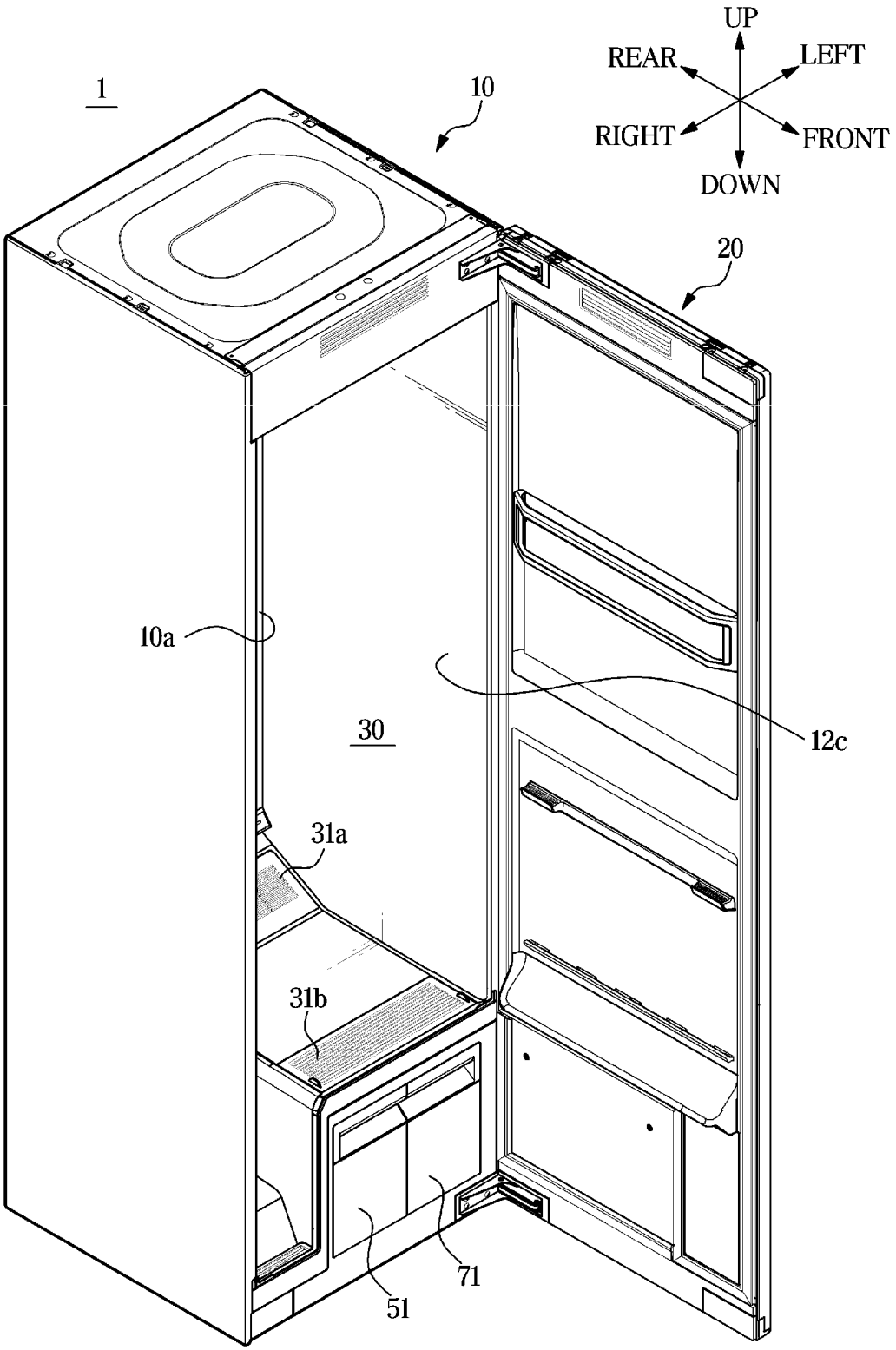
FIG. 2 is a view illustrating a state in which a door is open in the clothes care apparatus illustrated in FIG. 1 according to an embodiment of the present invention.
Figure 3:
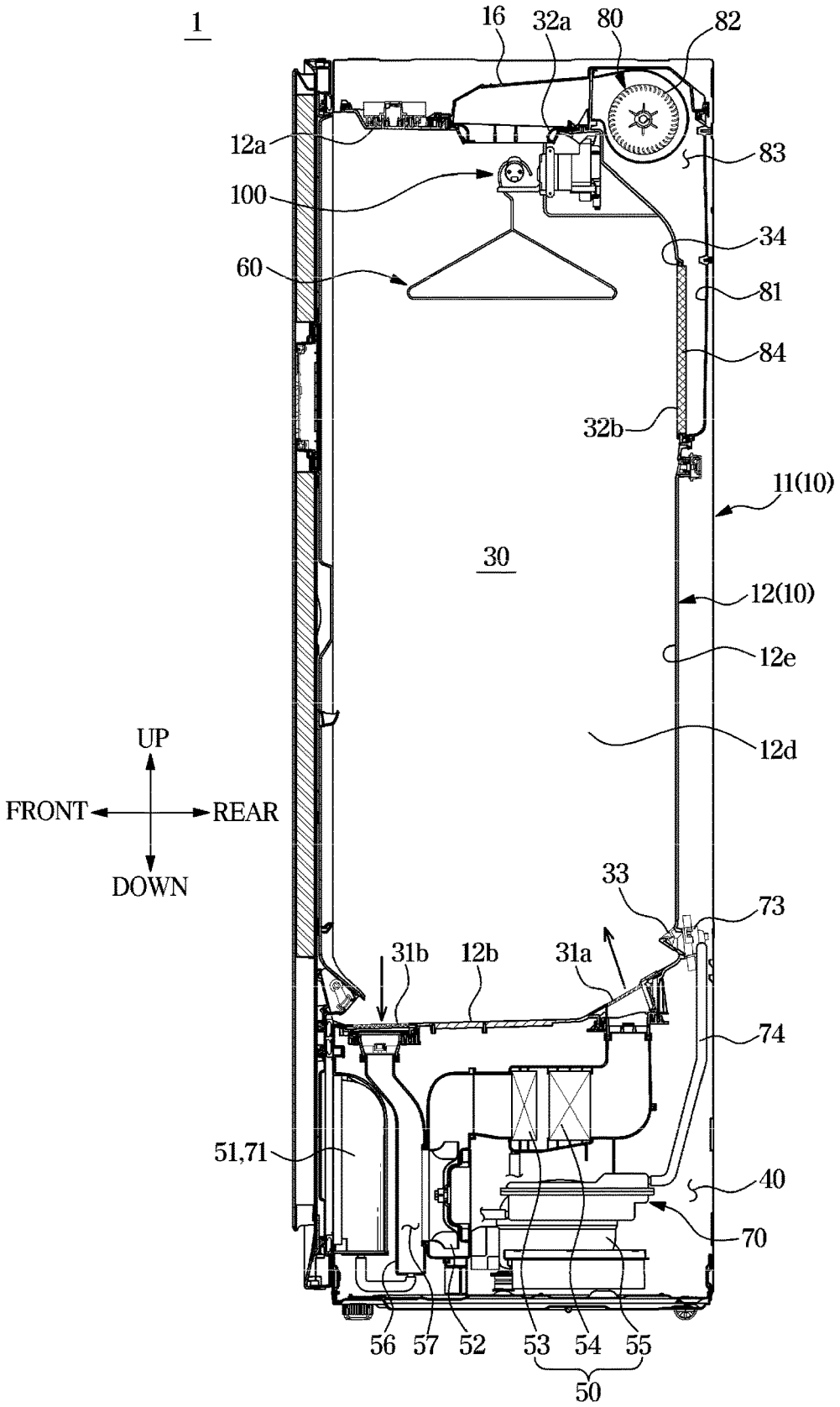
FIG. 3 is a side cross-sectional view of the clothes care apparatus illustrated in FIG. 1 according to an embodiment of the present invention.

As illustrated in FIGS. 1 to 3, a clothes care apparatus 1 may include a main body 10 forming an exterior and a door 20 rotatably coupled to the main body 10.

The main body 10 may have a substantially hexahedral shape with one open surface. An opening 10*a* may be formed on a front surface of the main body 10. The door 20 rotatably coupled to open and close a care chamber 30 may be installed in the main body 10.

Although not illustrated in the drawing, the door 20 may be installed in the main body 10 through a hinge or a link.

The main body 10 may include the care chamber 30 that is provided inside the main body 10 and in which clothes are accommodated and taken care of. The front of the care chamber 30 may be formed with the opening 10*a*. The care chamber 30 may also be opened and closed by the door 20 for opening and closing the opening 10*a*.

As shown in FIGS. 2 and 3, the main body 10 may include an outer cabinet 11 and an inner cabinet 12 disposed inside the outer cabinet 11. The main body 10 may be provided with a clothes hanger 100 provided inside the care chamber 30 to hang a holding member 60 thereon.

The main body 10 may include a machine chamber 40 equipped with a heat exchange device 50 and the like provided to dehumidify or heat air inside the care chamber 30.

In the care chamber 30, a space in which clothes (not shown) are accommodated may be formed. The care chamber 30 may be configured to include an upper surface 12*a*, a lower surface 12*b*, a left surface 12*c*, a right surface 12*d*, and a rear surface 12*e* provided in the inner cabinet 12.

The inner cabinet 12 may include a frame (not shown) provided to support the upper surface 12*a*, the lower surface 12*b*, the left surface 12*c*, the right surface 12*d*, and the rear surface 12*e*.

The frame (not shown) may form the care chamber 30 and the machine chamber 40 disposed under the care chamber 30. However, the frame is not limited thereto.

The clothes hanger 100 may be fixed inside the care chamber 30. The clothes hanger may be fixed to an upper middle portion of the inside of the care chamber 30. However, the clothes hanger is not limited thereto, and a plurality of clothes hangers may be provided and fixed in the care chamber 30 according to the volume of the care chamber 30. For example, two clothes hangers 100 may be provided and fixed to an upper portion and a center of the care chamber 30, respectively.

At least one holding member 60 may be provided. The holding member 60 may be formed in a shape of a hanger so that clothes may be hung thereon. However, the holding member is not limited thereto.

At an upper end of the holding member 60, a hanging portion 61 may be provided to be held on the clothes hanger 100. The hanging portion 61 may be provided in a substantially hook shape. The hanging portion 61 may include an upper end 61*a* of the hanging portion 61 supported by a support bar 110 of the clothes hanger 100 and a lower end 61*b* of the hanging portion 61 provided to perform a reciprocating motion by a swing hook 130.

The lower end 61*b* of the hanging portion 61 may extend from the upper end of the holding member 60, and the upper end 61*a* of the hanging portion 61 may be positioned at the top of the hook shape. A structural relationship between the holding member 60 and the clothes hanger 100 will be described below in detail.

The care chamber 30 may include a first outlet 31*a* and a second outlet 32*a*, a first inlet 31*b* and a second inlet 32*b*, and a steam outlet 33.

The first outlet 31*a* and the first inlet 31*b* may be formed in the lower surface 12*b* of the care chamber 30. The first outlet 31*a* may be disposed at the rear of the lower surface 12*b* of the care chamber 30. The first inlet 31*b* may be disposed in front of the lower surface 12*b* of the care chamber 30. The first outlet 31*a* and the first inlet 31*b* may be disposed at positions adjacent to each other.

The steam outlet 33 may be disposed at a lower portion of the rear surface 12*e* of the care chamber 30. The steam outlet 33 may be disposed above the first outlet 31*a*.

The second outlet 32*a* may be formed in the upper surface 12*a* of the care chamber 30. The second inlet 32*b* may be formed at the center of the rear surface 12*e* of the care chamber 30. The second outlet 32*a* and the second inlet 32*b* may be disposed at positions adjacent to each other.

The clothes hanger 100 may be disposed under the second outlet 32*a* of the care chamber 30. Air discharged through the second outlet 32*a* may be blown toward the holding member 60 hung on the clothes hanger 100 and may be transferred to the clothes held on the holding member 60.

A lower portion of the main body 10 may be provided with a drainage container 51 and a water supply container 71 detachably provided from the main body 10. The drainage container 51 and the water supply container 71 may be disposed under the care chamber 30.

The drainage container 51 may be provided to facilitate treatment of condensed water by the heat exchange device 50. The water supply container 71 may store water necessary for generating steam in a first steam generating device 70.

Water in the water supply container 71 may be supplied to the first steam generating device 70 and used to generate steam. The water supply container 71 may be detachably installed from the main body 10 to facilitate water replenishment.

The drainage container 51 and the water supply container 71 may be provided in front of the machine chamber 40. The machine chamber 40 may be provided on a lower side of the main body 10. The machine chamber 40 may be provided under the care chamber 30.

A plurality of hoses may be provided, and each of the plurality of hoses may be used for the heat exchange device 50 or the first steam generating device 70.

The heat exchange device 50 may be provided to dehumidify and heat the air inside the care chamber 30 as needed.

The heat exchange device 50 may be installed to supply hot air to the inside of the care chamber 30. The heat exchange device 50 may include an evaporator 53, a condenser 54, and a compressor 55 through which a refrigerant circulates, and may be provided to dehumidify and heat air.

As the refrigerant evaporates in the evaporator 53 of the heat exchange device 50, the refrigerant may absorb latent heat from the surrounding air, and thus moisture in the air may be condensed and removed.

When the refrigerant is condensed in the condenser 54 through the compressor 55, latent heat may be released toward the surrounding air, thereby heating the surrounding air.

The evaporator 53 and the condenser 54 may perform a heat exchange function so that air introduced into the machine chamber 40 by a first fan 52 may be dehumidified and heated by sequentially passing through the evaporator 53 and the condenser 54.

The heat exchange device 50 installed in the machine chamber 40 may include a first duct 56 for connecting the evaporator 53, the condenser 54, and the first fan 52, and the first duct 56 may be connected to the care chamber 30 to form a first flow path 57 circulating between the care chamber 30 and the first duct 56.

The first duct 56 may be connected to the first outlet 31*a* and the first inlet 31*b* of the care chamber 30. One end of the first duct 56 may be connected to the first outlet 31*a*, and the other end thereof may be connected to the first inlet 31*b*.

The air in the care chamber 30 may be introduced into the first duct 56 through the first inlet 31*b*, and the introduced air may be dehumidified and discharged back to the care chamber 30 through the first outlet 31*a*.

The first outlet 31*a* may be disposed at the rear of the care chamber 30, and the first inlet 31*b* may be disposed in front of the care chamber 30. However, positions of first outlet 31*a* and the first inlet 31*b* are not limited thereto. The positions of the first outlet 31*a* and the first inlet 31*b* may be variously changed as needed.

The first duct 56 may be provided to dehumidify the air introduced through the first inlet 31*b* and discharge the dehumidified air through the first outlet 31*a*. The first fan 52 may be provided at the first duct 56 to suck air from the care chamber 30 into the first duct 56.

The first steam generating device 70 may be provided in the machine chamber 40 to generate steam by receiving water from the water supply container 71.

The first steam generating device 70 may be connected to the water supply container 71 to receive water and generate steam, and may include a steam supply pipe 74 for guiding the generated steam to a steam sprayer 73. The steam sprayer 73 may be disposed at the lower portion of the rear surface 12*e* of the care chamber 30.

The steam sprayer 73 may have an end portion formed in a nozzle shape to smoothly spray steam into the inner space of the care chamber 30, and may be installed to be exposed to the inside of the care chamber 30.

The care chamber 30 may include a blower 80 for causing the air in the care chamber 30 to flow. The blower 80 may include a second duct 81 and a second fan 82 may be installed in the second duct 81.

The second duct 81 may be provided in communication with the care chamber 30 to form a second flow path 83 circulating between the care chamber 30 and the second duct 81. The second fan 82 may be disposed on the second flow path 83.

The second duct 81 may be formed behind the second inlet 32*b* of the care chamber 30. The second duct 81 may be provided at the upper portion of the rear surface 12*e* of the care chamber 30 and may include a filter 84 therein.

The filter 84 may include a high efficiency particulate air (HEPA) filter 84. However, the filter is not limited thereto.

The second duct 81 may be combined with a top cover 16 disposed above the care chamber 30. The blower 80 may be disposed above and behind the care chamber 30 and may include a motor (not shown) for generating a rotational force and at least one second fan 82 rotated by the motor (not shown).

A pair of second fans 82 may be provided as centrifugal fans for sucking in air in an axial direction and discharging air outward in a radial direction. However, the second fan 82 is not limited thereto.

The second duct 81 may be connected to the second outlet 32*a* and the second inlet 32*b* of the care chamber 30. One end of the second duct 81 may be connected to the second outlet 32*a*, and the other end thereof may be connected to the second inlet 32*b* of the care chamber 30.

The second outlet 32*a* may be opened toward the clothes hanger 100 so that air in the second duct 81 may be transferred to the holding member 60.

The second fan 82 disposed inside the second duct 81 may be provided to introduce the air inside the care chamber 30 through the second inlet 32*b* and discharge the introduced air through the second outlet 32*a*.

A filter installation portion 34 for installing the filter 84 may be provided on the rear surface 12*e* of the care chamber 30. The second inlet 32*b* may be formed at a position corresponding to the filter installation portion 34.

When air inside the care chamber 30 flows into the second duct 81, the air may be filtered by the filter 84 of the second inlet 32*b*. Dust and odor may be removed from the air introduced into the second duct 81 by the filter 84.

The air filtered by the filter 84 may be discharged to the clothes hanger 100 through the blower 80. The filter 84 may include a dust collecting filter (not shown) for removing dust or a means for deodorizing.

When providing care for clothes, the care chamber 30 may be operated in a state in which clothes are held on the holding member 60 and the door 20 is closed. In the care chamber 30, air may be circulated along the first flow path 57 and the second flow path 83.

Figure 4:
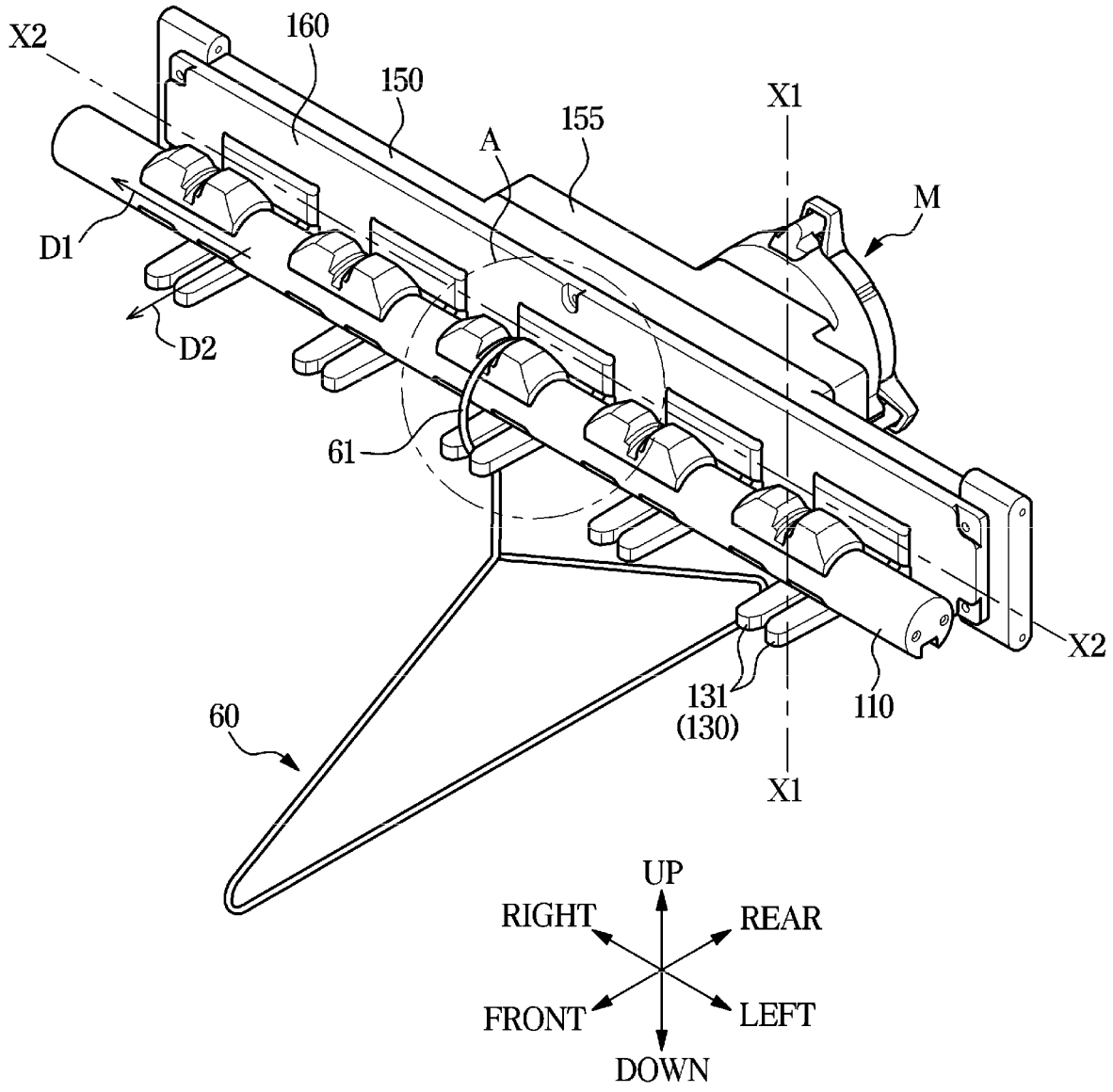
FIG. 4 is a perspective view of a clothes hanger included in the clothes care apparatus according to one embodiment of the present invention.
Figure 5:
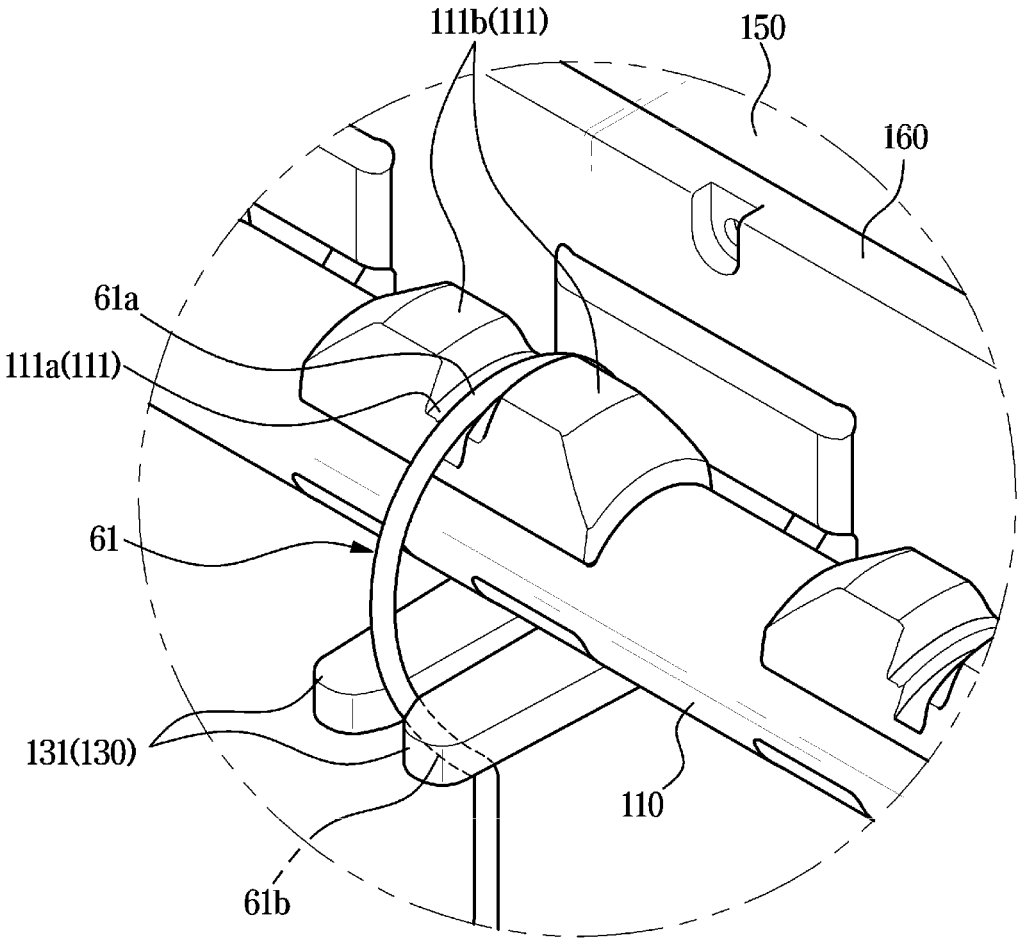
FIG. 5 is an enlarged view of an area A illustrated in FIG. 4 according to an embodiment of the present invention.
Figure 6:
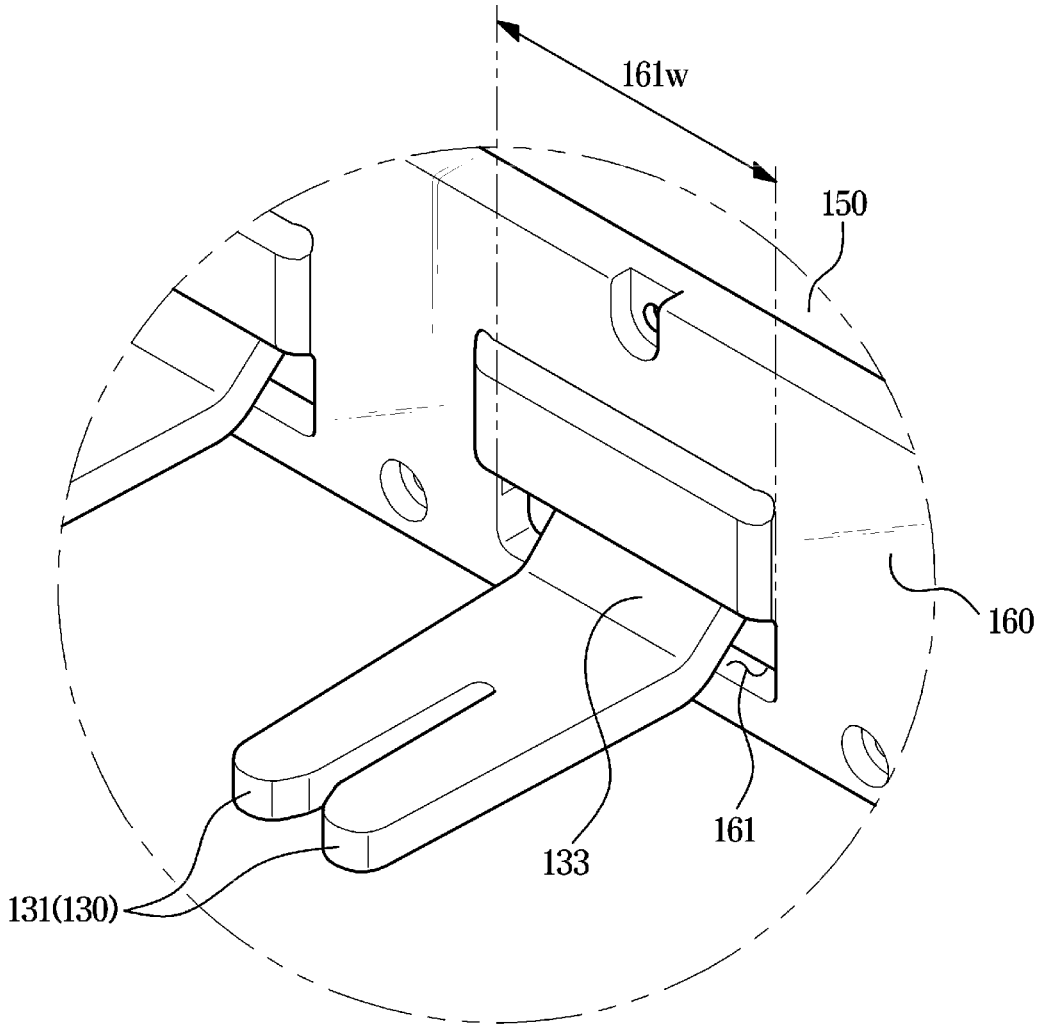
FIG. 6 is a view in which a support bar is removed from the enlarged view of FIG. 5 according to an embodiment of the present invention.
Figure 7:
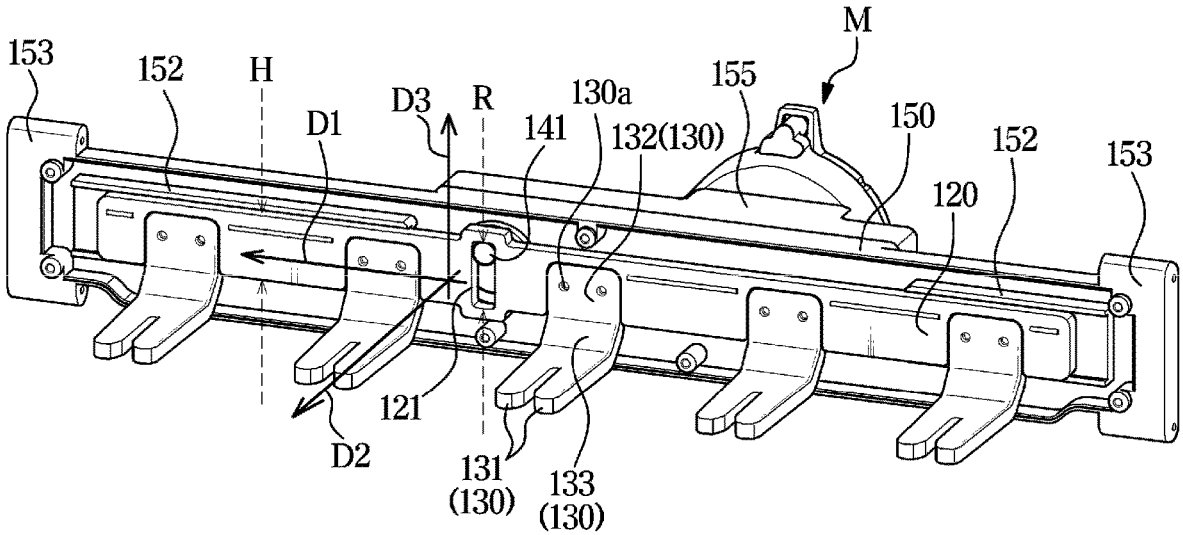
FIG. 7 is a perspective view in which a hanger cover is removed from the clothes hanger of FIG. 4 according to an embodiment of the present invention.
Figure 8:
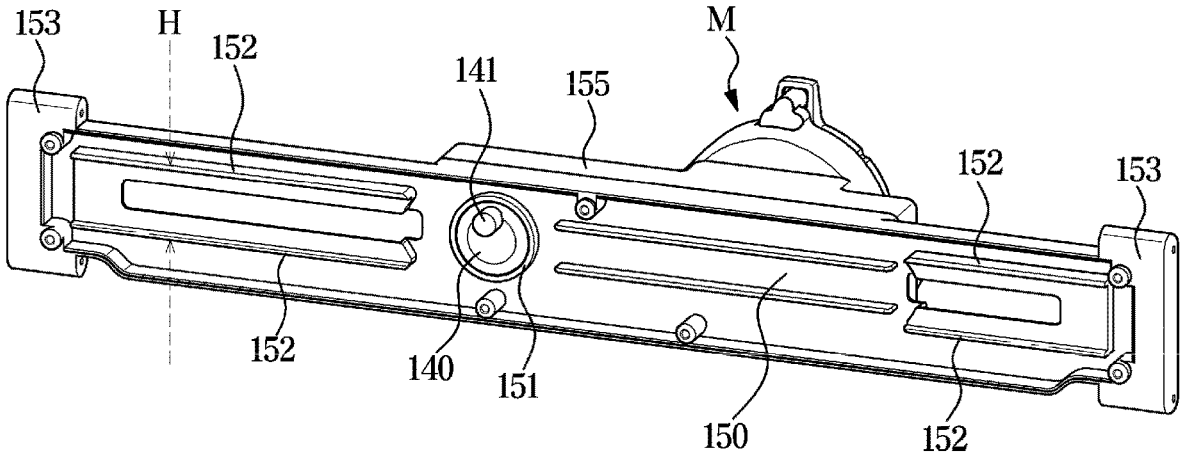
FIG. 8 is a view in which a slider and a swing hook of FIG. 7 are removed according to an embodiment of the present invention.
Figure 9:
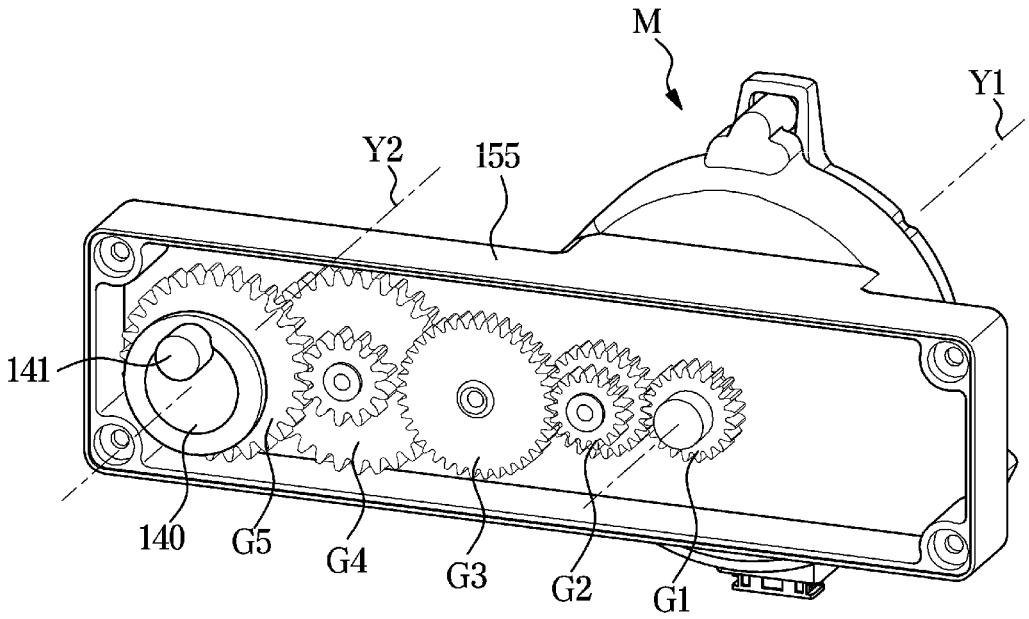
FIG. 9 is a view in which a sliding base of FIG. 8 is removed according to an embodiment of the present invention.
Figure 10:
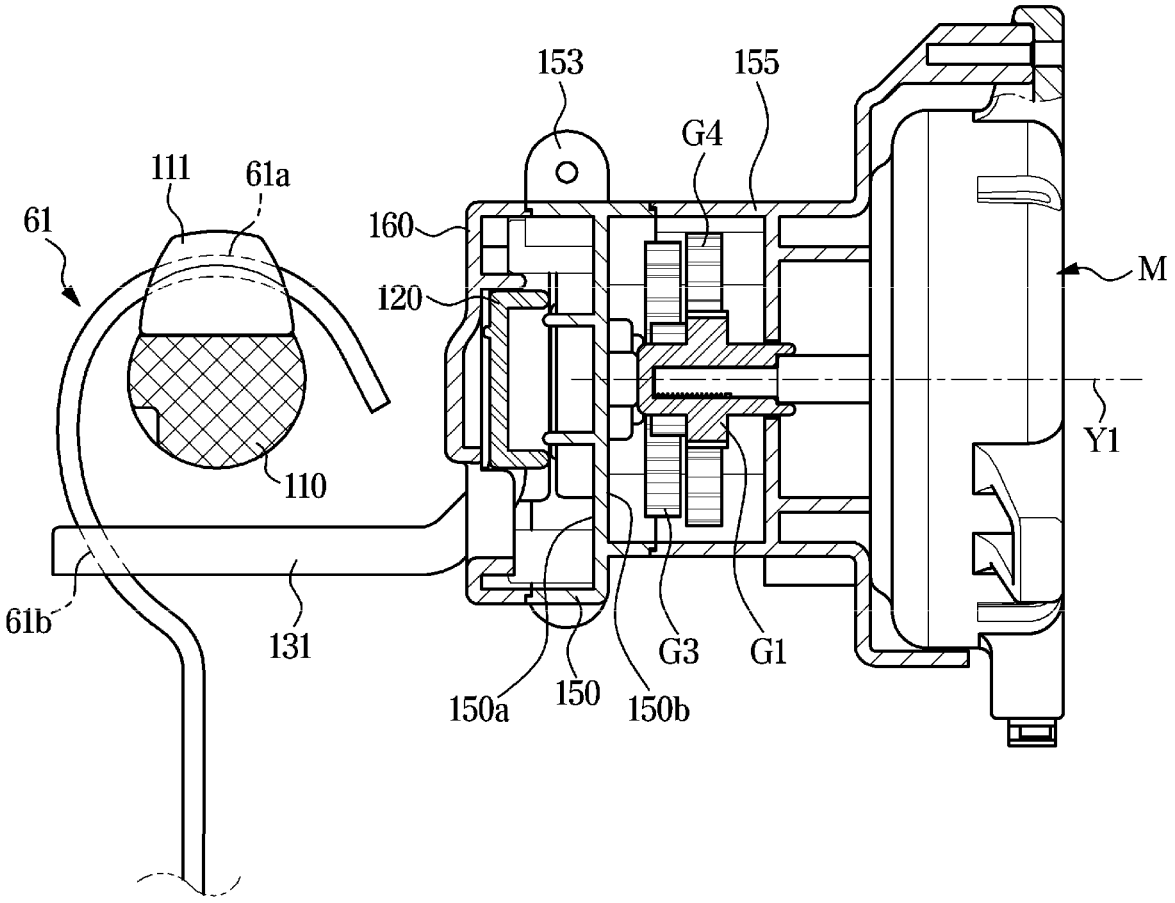
FIG. 10 is a cross-sectional view taken along line X1-X1 of FIG. 1 according to an embodiment of the present invention.
Figure 11:
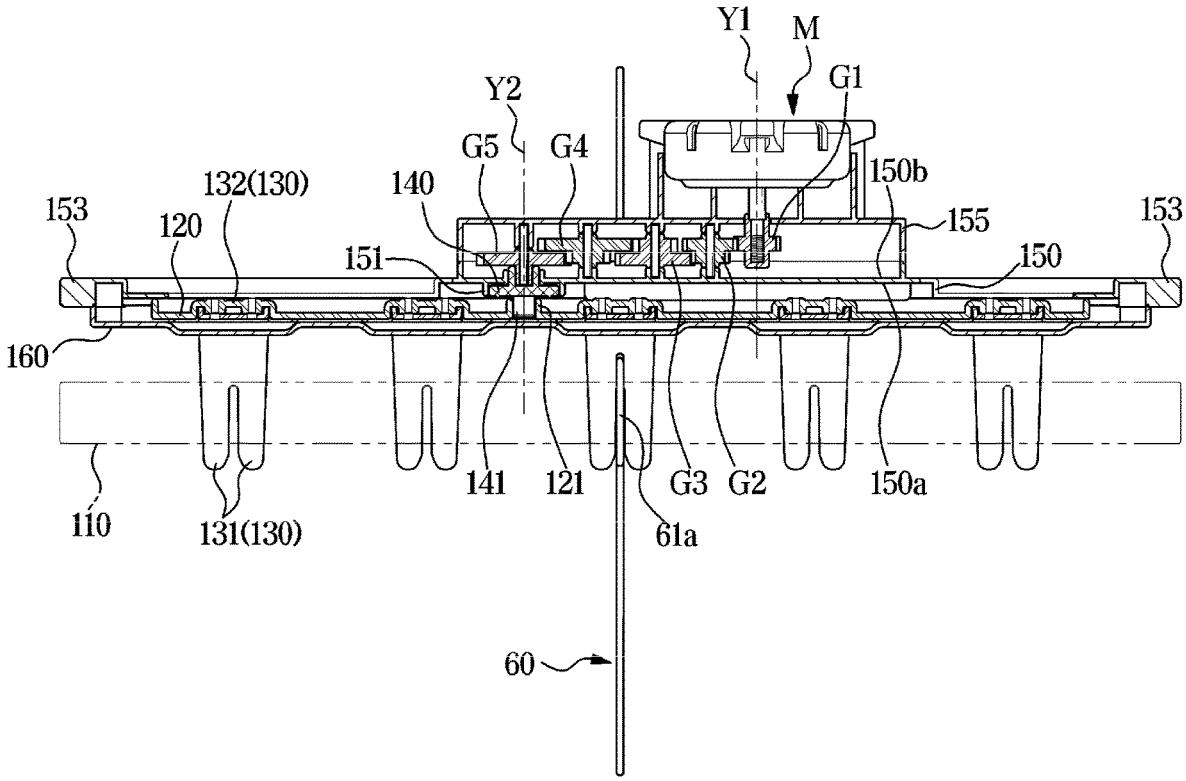
FIG. 11 is a cross-sectional view taken along line X2-X2 of FIG. 1 according to an embodiment of the present invention.

FIG. 4 is a perspective view of the clothes hanger included in the clothes care apparatus according to one embodiment of the present invention. FIG. 5 is an enlarged view of an area A illustrated in FIG. 4. FIG. 6 is a view in which the support bar is removed from the enlarged view of FIG. 5. FIG. 7 is a perspective view of the clothes hanger of FIG. 4 in which a hanger cover is removed. FIG. 8 is a view in which a slider and the swing hook of FIG. 7 are removed. FIG. 9 is a view in which a sliding base of FIG. 8 is removed. FIG. 10 is a cross-sectional view taken along X1-X1 of FIG. 1. FIG. 11 is a cross-sectional view taken along X2-X2 of FIG. 1.

The clothes care apparatus 1 may primarily perform a function (primary function) of supporting the holding member 60 on which clothes (not shown) are held. Secondarily, the clothes care apparatus 1 may perform a function (secondary function) of shaking the clothes (not shown) held on the holding member 60 for certain period of time to effectively remove the odor remaining in the clothes (not shown) and smooth wrinkles.

In the related art, in order to implement the above-mentioned secondary function, a point (support point) at which the holding member where the clothes are held is supported and a point (action point) at which the holding member is shaken take the same position. Therefore, a displacement of the action point has to be large, resulting in a problem of increased wear of parts and increased vibration noise. Therefore, it is necessary to separate the support point and the action point to maximize the shaking of clothes held on the holding member even with a small amount of kinetic energy. Hereinafter, the clothes hanger 100 provided in a structure in which the support point and the action point are separated will be described in detail.

The clothes hanger 100 may include the support bar 110 fixed inside the care chamber 30, the swing hook 130 for shaking the holding member 60 supported by the support bar 110, a slider 120 connected to the swing hook 130 and provided for performing a reciprocating motion, and a motor M providing a driving force for the reciprocating motion of the slider 120.

The support bar 110 may be provided in a bar shape extending in one direction. Both ends of the support bar 110 may be fixed inside the care chamber 30, specifically, to the left surface 12*c* and the right surface 12*d* of the care chamber. Referring to FIG. 4, one direction in which the support bar 110 extends may be a right-left direction. However, the direction in which the support bar 110 extends inside the care chamber 30 is not limited thereto.

The clothes hanger 100 may further include a support portion 111 disposed on the support bar 110 and provided so that the upper end 61*a* of the hanging portion 61 of the hanging portion 61 is hung. Referring to FIG. 5, the support portion 111 may include a seating part 111*a* on which the upper end 61*a* of the hanging portion 61 is supported and limiting parts 111*b* disposed at both ends of the seating part 111*a*. The limiting parts 111*b* may be provided to limit the movement of the upper end 61*a* of the hanging portion 61 in an extending direction of the support bar 110. Accordingly, the support portion 111 may be provided in an approximately M-shape. The support portion 111 may be disposed on an upper portion of the support bar 110 provided in a bar shape. As the support portion 111 is disposed on the upper portion of the support bar 110, the upper end 61*a* of the hanging portion 61 may be supported by the seating part 111*a*.

The limiting parts 111*b* may be provided to protrude outward in a radial direction of the support bar 110. A protruding direction may protrude toward the upper portion of the care chamber 30.

A plurality of support portions 111 may be provided in order to hold the plurality of holding members 60. The plurality of support portions 111 may be arranged at regular intervals along the extending direction of the support bar 110. The support portions 111 may be arranged at regular intervals along the extending direction of the support bar 110 at positions corresponding to the plurality of swing hooks 130.

The support bar 110 and the support portion 111 of the clothes hanger 100 included in the clothes care apparatus 1 according to one embodiment of the present invention are disclosed as separate components, but are not limited thereto. The support bar 110 and the support portion 111 may be integrally formed.

The slider 120 and the swing hook 130 may be provided to be connected to each other. The swing hook 130 may be fixed to the slider 120 through a fastener 130*a* (see FIG. 7). A plurality of swing hooks 130 may be provided, and may be arranged at regular intervals along an extending direction of the slider 120.

The slider 120 may perform a reciprocating motion in parallel with a first direction D1. The reciprocating motion of the slider 120 may be provided to be a linear reciprocating motion.

The slider 120 may extend parallel to the first direction D1. The slider 120 may be provided in a bar shape. The first direction D1 in which the slider 120 extends may be parallel to the extending direction of the support bar 110. That is, the first direction D1 in which the slider 120 extends may be a right-left direction, which is one direction in which the support bar 110 extends. However, the extending direction of the slider 120 is not limited thereto.

The slider 120 may include an interlocking slit 121 provided to convert the rotational motion of the motor M into the linear reciprocating motion of the slider 120. The interlocking slit 121 may be formed to pass through the slider 120. The interlocking slit 121 may be formed to pass through the slider 120 in a thickness direction.

An extending direction of the interlocking slit 121 may be formed in parallel with a third direction D3 perpendicular to the first direction D1. An interlocking protrusion 141 of an interlocking portion 140, which rotates on a rotation axis parallel to the rotation axis of the motor M, is inserted into the interlocking slit 121, and thus the rotational motion of the motor M may be converted into the linear reciprocating motion of the slider 120. A structural relationship between the interlocking slit 121 and the interlocking portion 140 will be described below in detail.

The swing hook 130 may be provided to grip the lower end 61*b* of the hanging portion 61 of the hanging portion 61 hanging on the support bar 110 and the support portion 111. The swing hook 130 may include a pair of pressing parts 131 provided to grip the lower end 61*b* of the hanging portion 61. The pair of pressing parts 131 may be provided so that the lower end 61*b* of the hanging portion 61 is disposed between pressing parts 131.

The pair of pressing parts 131 of the swing hook 130 may be provided in a second direction D2 intersecting the extending direction of the support bar 110. An angle between the extending direction of the support bar 110 and the second direction may be a right angle. However, the extending direction of the pair of pressing parts 131 is not limited thereto.

The swing hook 130 may further include a hook fixing part 132 extending upward from rear ends of the pair of pressing parts 131. The pair of pressing parts 131 and the hook fixing part 132 may be provided in a substantially L-shaped bent form. A bent portion 133 connecting the pair of pressing parts 131 and the hook fixing part 132 may be provided between the pair of pressing parts 131 and the hook fixing part 132. The fastener 130*a* may be provided in the hook fixing part 132, and the swing hook 130 may be fixed to the slider 120 through the fastener 130*a*.

Since the swing hook 130 is provided in the bent shape composed of the pair of pressing parts 131 and the hook fixing part 132, a structure in which the upper end 61*a* of the hanging portion 61 of the hanging portion 61 is supported by the support bar 110 and the support portion 111, and the lower end 61*b* of the hanging portion 61 of the hanging portion 61 is shaken by the swing hook 130 may be provided. That is, when the point where the upper end 61*a* of the hanging portion 61 is supported by the support bar 110 and the support portion 111 is defined as the support point, and the point where the lower end 61*b* of the hanging portion 61 is gripped by the swing hook 130 is defined as the action point, a structure in which the support point and the action point are separated may be easily implemented.

The hanging portion 61 may be provided so that the upper end 61*a* of the hanging portion 61 is supported at one point by the support portion 111 and the lower end 61*b* of the hanging portion 61 reciprocates by the swing hook 130 and thus clothes (not shown) held on the holding member 60 are shaken.

However, the shape of the swing hook 130 is not limited thereto, and even if the swing hook 130 is not provided in the bent shape, a structure in which the support point and the action point are separated by disposing the slider 120 to which the swing hook 130 is connected at a position lower than that of the support bar 110 may be implemented.

Referring to FIGS. 6 and 7, the clothes hanger 100 may further include a sliding base 150 for supporting the slider 120. The sliding base 150 may support the slider 120 so that the slider 120 is able to perform the reciprocating motion in a specific area inside the care chamber 30.

The sliding base 150 may extend in parallel with the first direction D1, which is a direction in which the slider 120 extends. Both ends of the sliding base 150 may be fixed inside the care chamber 30, specifically, to the left surface 12*c* and the right surface 12*d* of the care chamber 30. The sliding base 150 may include base fixing parts 159 fixed to the care chamber 30 at both ends. Referring to FIG. 4, the direction in which the sliding base 150 extends may be a right-left direction. However, the direction in which the sliding base 150 extends inside the care chamber 30 is not limited thereto.

Referring to FIGS. 4 to 6, the clothes hanger 100 may further include a hanger cover 160 coupled to the sliding base 150.

The hanger cover 160 may be provided in a shape corresponding to the sliding base 150. An edge shape of the hanger cover 160 may be provided in a shape corresponding to an edge shape of the sliding base 150. The hanger cover 160 may be disposed in front of the sliding base 150 and fixed to the sliding base 150. The hanger cover 160 may perform a function of supporting the slider 120 to prevent the slider 120 disposed inside the sliding base 150 from escaping to the outside of the sliding base 150.

Referring to FIG. 6, the hanger cover 160 may include a cover hole 161 so that the swing hook 130 protrudes into the care chamber 30. The cover hole 161 may be provided in a cut shape to correspond to a reciprocating motion range of the swing hook 130. The cover hole 161 may be provided with a cover hole cut width 161*w* that is equal to or longer than a reciprocating motion range width W (see FIG. 12) of the swing hook 130.

The pair of pressing parts 131 may protrude into the care chamber 30 through the cover hole 161. In the cover hole 161, the bent portion 133 to which the pair of pressing parts 131 and the hook fixing part 132 are connected may be disposed adjacent to the cover hole 161.

Since the cover hole 161 is formed to correspond to the swing hook 130, when a plurality of swing hooks 130 are provided, a plurality of cover holes 161 may also be provided corresponding to the number of swing hooks.

The sliding base 150 may further include a slider guide 152 to support the slider 120. The slider guide 152 may be provided to support both ends of the edge of the slider 120 so that the slider 120 performs the linear reciprocating motion in the first direction D1.

The slider guide 152 may be provided in a rail shape. The rail-shaped structure of the slider guide 152 may be provided at an interval corresponding to a height H of the slider 120.

The sliding base 150 may include a first surface 150*a* on which the slider 120 is seated and a second surface 150*b* positioned opposite to the first surface 150*a*. The motor M may be fixed to the second surface 150*b*.

The sliding base 150 may include an interlocking hole 151 through the sliding base 150 so that the first surface 150*a* and the second surface 150*b* are connected. The interlocking hole 151 may be provided to support the interlocking portion 140 for converting the rotational motion of the motor M into the linear reciprocating motion of the slider 120. The interlocking hole 151 may be provided in a shape corresponding to the shape of the interlocking portion 140.

Referring to FIGS. 7 to 11, the clothes hanger 100 may further include the interlocking portion 140 rotating around an interlocking portion rotation axis Y2 in parallel with a motor rotation axis Y1.

The interlocking portion 140 may be provided as a circular plate. The interlocking portion 140 may include the interlocking protrusion 141 formed at a position spaced apart from a rotation center of the interlocking portion 140. The interlocking protrusion 141 may protrude from the plate-shaped surface in a direction parallel to the interlocking portion rotation axis Y2. The interlocking protrusion 141 of the interlocking portion 140 may be inserted into the interlocking slit 121 so that the rotational motion of the motor M may be converted into the linear reciprocating motion of the slider 120.

The interlocking portion rotation axis Y2 of the interlocking portion 140 may be disposed in parallel at a position spaced apart from the motor rotation axis Y1 of the motor M. A plurality of gears G1 to G5 may be provided between the motor M and the interlocking portion 140 so that the driving force of the motor M may be transmitted to the interlocking portion 140. The plurality of gears G1 to G5 may be disposed inside the gear cover 155, and the motor M may be fixed to the sliding base 150 with the gear cover 155 interposed therebetween. The motor M may be fixed to the gear cover 155, and the gear cover 155 may be provided to be fixed to the sliding base 150. The gears G1 to G5 or the motor M may be disposed on a second surface 150*b* of the sliding base 150. However, the structural relationship between the interlocking portion 140 and the motor M is not limited thereto, and the interlocking portion 140 may be directly connected to the motor M.

Figure 12:
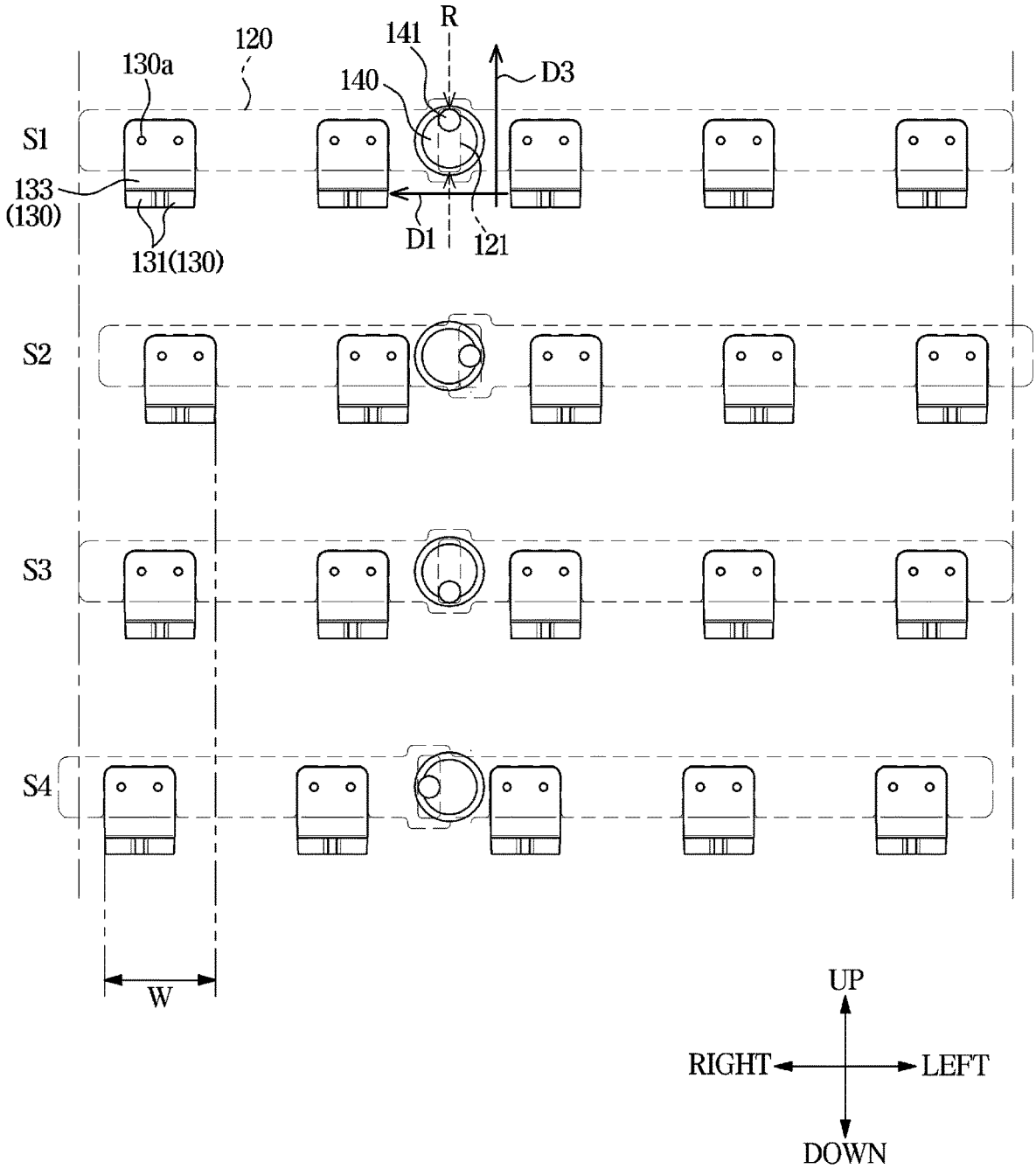
FIG. 12 is a diagram illustrating steps of a reciprocating motion of a slider of a clothes hanger included in the clothes care apparatus according to one embodiment of the present invention.

FIG. 12 is a diagram illustrating steps of the reciprocating motion of the slider of the clothes hanger included in the clothes care apparatus according to one embodiment of the present invention.

FIG. 12 shows steps of the reciprocating motion of the slider 120 of the clothes hanger 100 in four steps. In a first step S1, the interlocking protrusion 141 is in a state in which the interlocking protrusion 141 is at its uppermost position.

Based on the first step, the interlocking portion 140 may rotate clockwise. However, the interlocking portion 140 does not rotate only in a clockwise direction, and may also rotate in a counterclockwise direction according to a control method for the clothes care apparatus 1, and may be provided to rotate in various modes by appropriately combining the clockwise and counterclockwise directions. The positions of the interlocking protrusion 141 and the slider 120 in the first step S1 may be defined as an initial position.

A second step S2, a third step S3, and a fourth step S4 may correspond to a state in which the interlocking portion 140 rotates 90 degrees clockwise from the first step S1, a state in which the interlocking portion 140 rotates 180 degrees clockwise, and a state in which the interlocking portion 140 rotates 270 degrees clockwise, respectively.

A cut width of the interlocking slit 121 may be provided to have a length corresponding to the interlocking protrusion 141, and an extending direction of the interlocking slit may be formed in parallel with the third direction D3 perpendicular to the first direction D1. Referring to the first step S1 and the third step S3, a height R of the interlocking slit 121 may be provided to correspond to a magnitude of a displacement of the interlocking protrusion 141 between its uppermost position in the first step S1 and its lowermost position in the third step S3. The linear reciprocating motion of the slider 120 is performed in parallel with the first direction D1 as described above.

Movement of the slider 120 in the direction parallel to the third direction D3 may be limited by the slider guide 152. Accordingly, the interlocking protrusion 141 may be provided to press the slider 120 only in the direction parallel to the first direction D1.

When the interlocking portion 140 rotates clockwise 90 degrees in the first step S1, the slider 120 moves to the left in parallel with the first direction D1. When the interlocking portion 140 rotates clockwise 90 degrees in the second step S2, the slider 120 moves to the right in parallel with the first direction D1. When the interlocking portion 140 rotates clockwise 90 degrees in the third step S3, the slider 120 moves to the right in parallel with the first direction D1. When the interlocking portion 140 rotates clockwise 90 degrees in the fourth step S4, the slider 120 moves to the left in parallel with the first direction D1. The interlocking protrusion 141 and the slider 120 may be provided to return to their original positions when the interlocking portion 140 rotates 360 degrees in the first step S1.

With the structure described above, the rotational motion of the motor M may be converted into the linear reciprocating motion of the slider 120. In addition, with the separation structure of the swing hook 130 fixed to the support bar 110 and the slider 120, the hanging portion 61 may be provided so that the upper end 61*a* of the hanging portion 61 is supported at one point by the support portion 111 and the lower end 61*b* of the hanging portion 61 reciprocates by the swing hook 130 and thus clothes (not shown) held on the holding member 60 are shaken. Since the support point and the action point are separated, it is possible to maximize shaking of clothes held on the holding member even with a small amount of kinetic energy.

Figure 13:
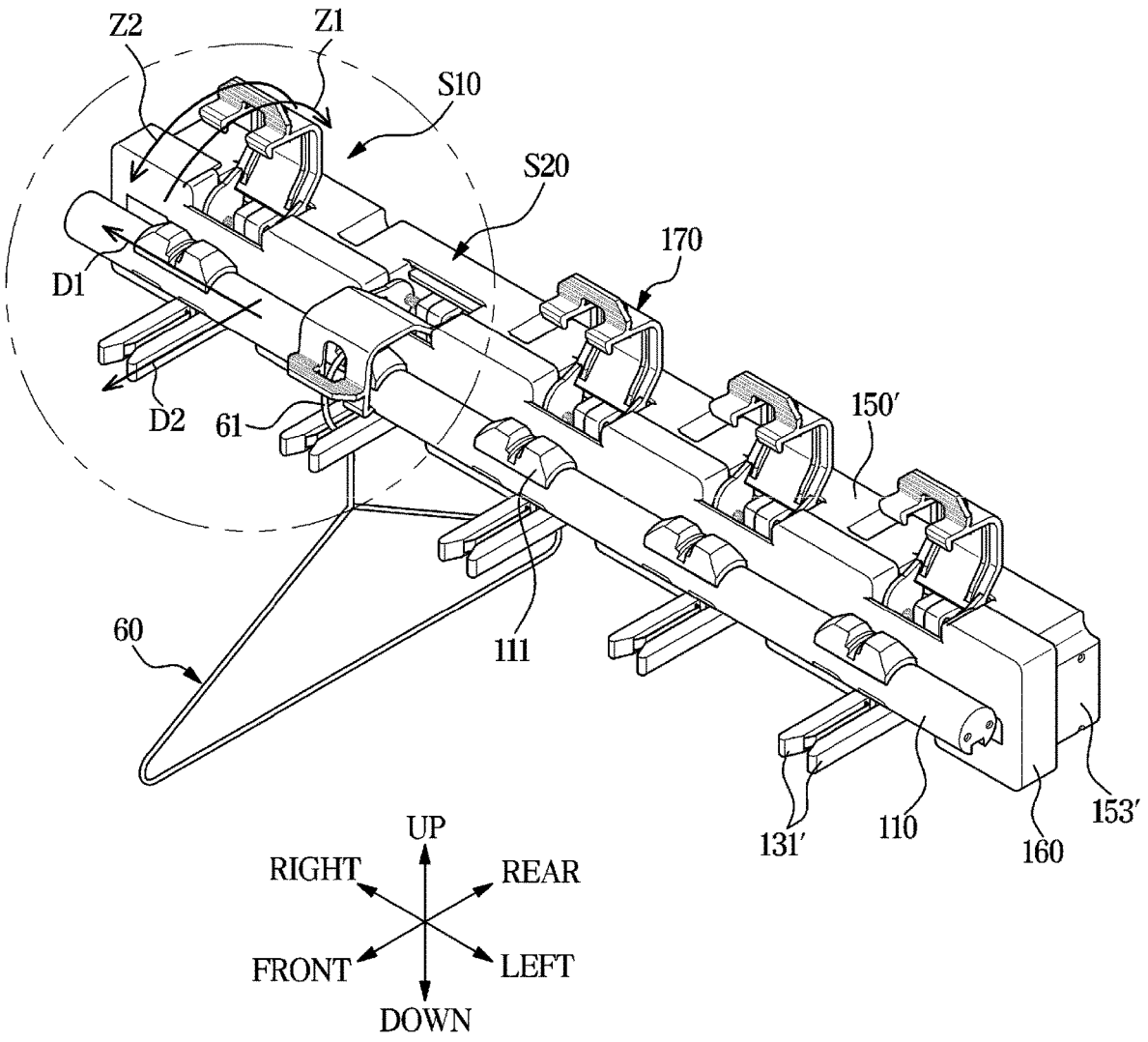
FIG. 13 is a perspective view of a clothes hanger included in a clothes care apparatus according to another embodiment of the present invention.
Figure 14:
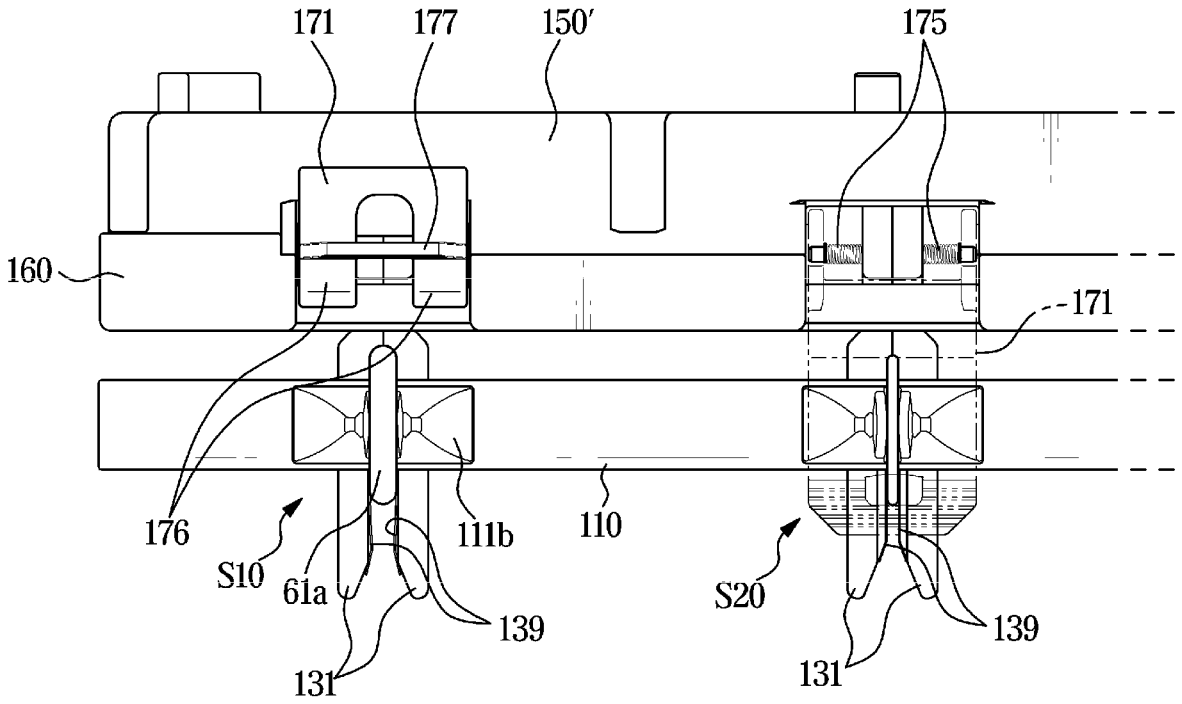
FIG. 14 is a plan view of a portion of the clothes hanger illustrated in FIG. 13 according to an embodiment of the present invention.
Figure 15:
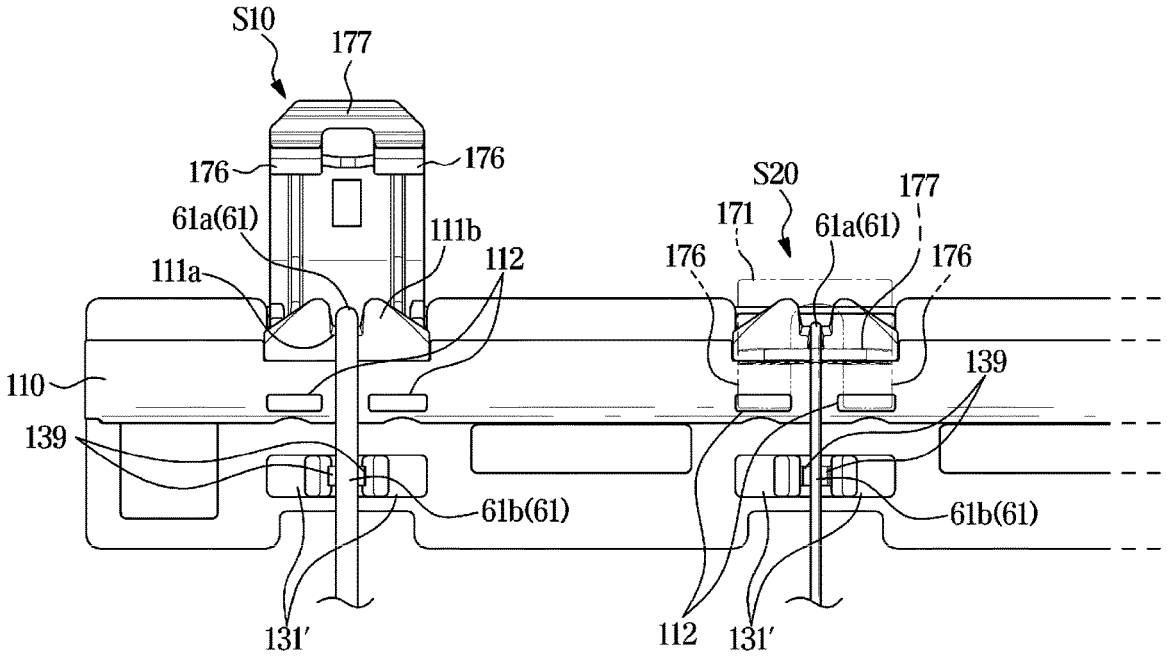
FIG. 15 is a front view of the portion of the clothes hanger illustrated in FIG. 13 according to an embodiment of the present invention.

FIG. 13 is a perspective view of a clothes hanger included in a clothes care apparatus according to another embodiment of the present invention. FIG. 14 is a plan view of a portion of the clothes hanger illustrated in FIG. 13. FIG. 15 is a front view of the portion of the clothes hanger illustrated in FIG. 13.

A difference between a clothes hanger 100' included in a clothes care apparatus 1 according to another embodiment of the present invention and the clothes hanger 100' included in the above-described clothes care apparatus according to one embodiment of the present invention is that a swing hook 130' may be connected to or disconnected from a slider 120' (see FIGS. 17 and 18) according to the direction of rotation of a cover link 170.

The clothes hanger 100' may include a support bar 110 fixed inside a care chamber 30, the swing hook 130' for shaking a holding member 60 supported by the support bar 110, and the slider 120' connected to the swing hook 130' and provided to perform a reciprocating motion, and since specific structures of the above components are the same as those described above, no redundant description will be provided, and only different configurations from those described above will be mainly described.

The clothes hanger 100' included in the clothes care apparatus 1 according to another embodiment of the present invention may further include the cover link 170. The cover link 170 may be rotatably provided on the sliding base 150'. The cover link 170 may be provided to selectively connect the swing hook 130' to the slider 120' according to a rotation direction.

Referring to FIG. 13, the cover link 170 may be provided to go into a first state S10 in which the swing hook 130' is disconnected from the slider 120' by rotating in a first rotation direction Z1 and to go into a second state S20 in which the swing hook 130' is connected to the slider 120' by rotating in a second rotation direction Z2.

The cover link 170 may be provided to be fixed to the support bar 110 while surrounding the support bar 110 in the second state S20. A body of the cover link 170 may be provided in a substantially hook shape.

The cover link 170 may include a fixing hook 176 formed at one end of the cover link 170. The fixing hook 176 may be provided at one end of the hook shape. The fixing hook 176 may be provided in a form in which one end of the cover link 170 is split so as not to limit an upper end of the hanging portion 61 in the second state S20.

A fixing groove 112 provided to correspond to the fixing hook 176 may be formed in the support bar 110. The cover link 170 may be switched from the first state S10 to the second state S20 in which the swing hook 130' is connected to the slider 120' by rotating in the second rotation direction Z2, and the cover link 170 may be temporarily elastically deformed so that the fixing hook 176 may be seated in the fixing groove 112.

The cover link 170 may further include a grip part 179 in an area adjacent to the fixing hook 176. The user may apply a force to the grip part 179 to switch the cover link 170 from the first state S10 to the second state S20 or from the second state S20 to the first state S10.

A structure for selectively connecting the swing hook 130' to the slider 120' will be described below in detail.

Referring to FIGS. 14 and 15, a pair of plate springs 139 may be provided in a pair of pressing parts 131'. The pair of plate springs 139 may be disposed between the pair of pressing parts 131'. The pair of plate springs 139 may be disposed to face each other. Depending on the thickness of the lower end 61*b* of the hanging portion 61, an interval between the pair of plate springs may be changed. Therefore, even when the hanging portions 613 and 614 of various thicknesses are disposed between the pair of pressing parts 131', the lower end 61*b* of the hanging portion 61 may be stably supported.

Figure 16:
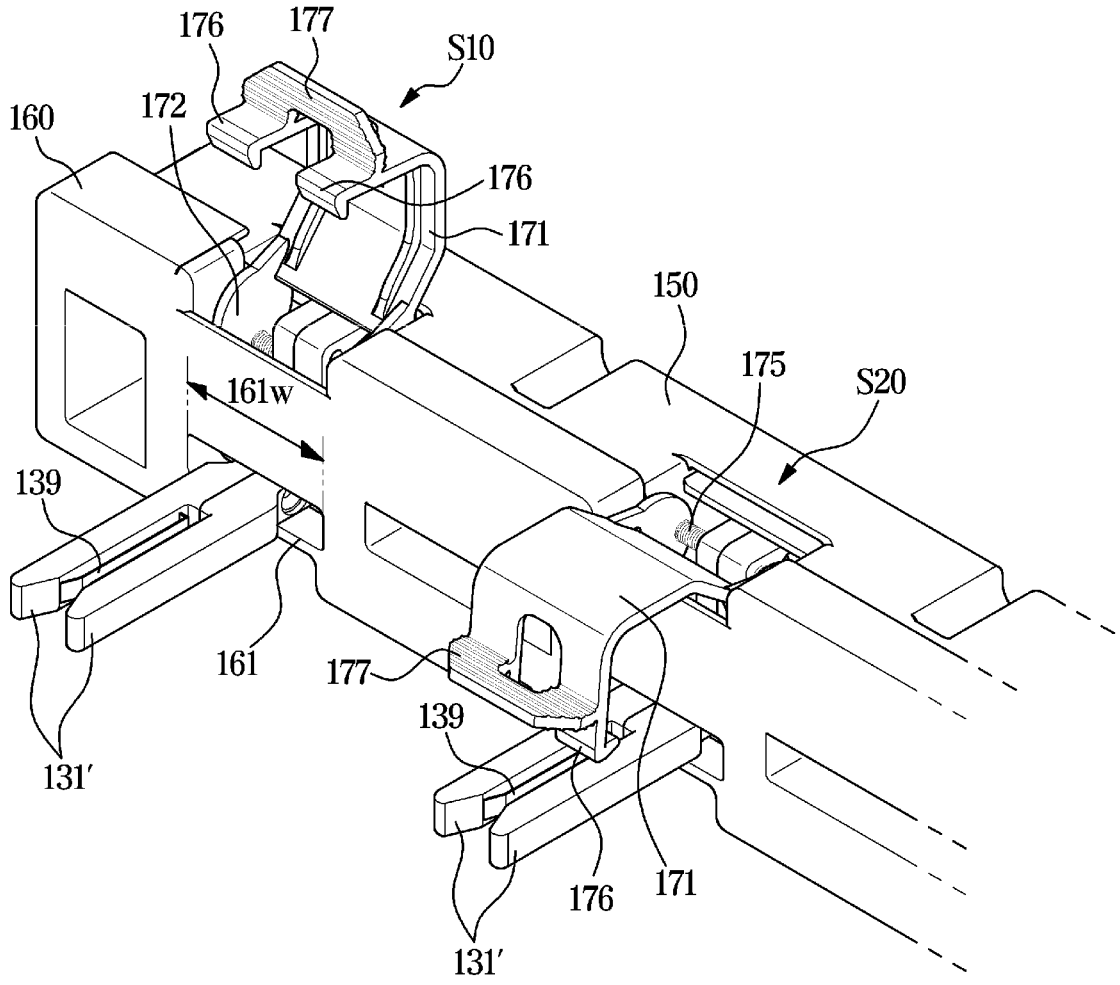
FIG. 16 is a perspective view of the portion of the clothes hanger illustrated in FIG. 13 according to an embodiment of the present invention.
Figure 17:
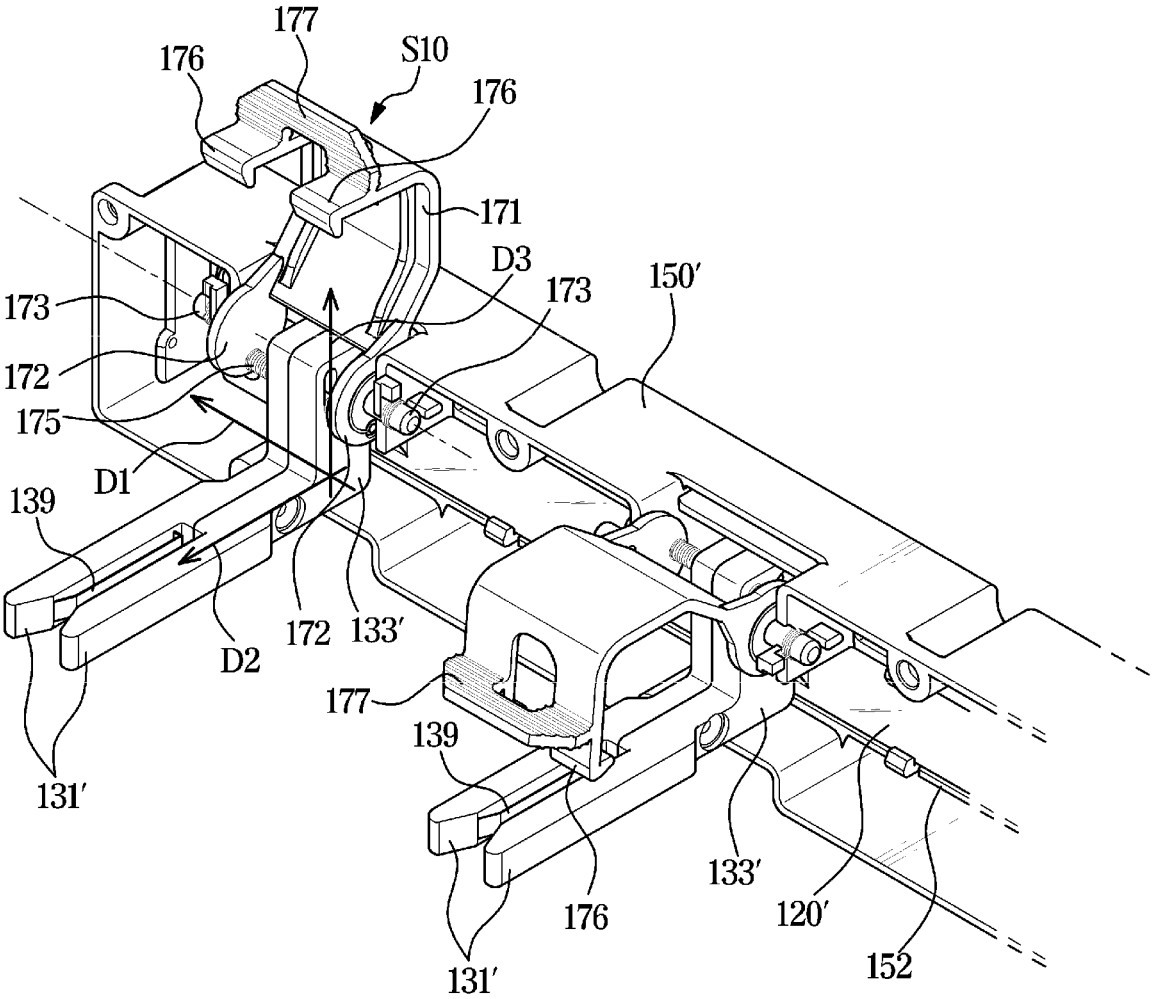
FIG. 17 is a perspective view in which a hanger cover is removed from the clothes hanger of FIG. 16 according to an embodiment of the present invention.
Figure 18:
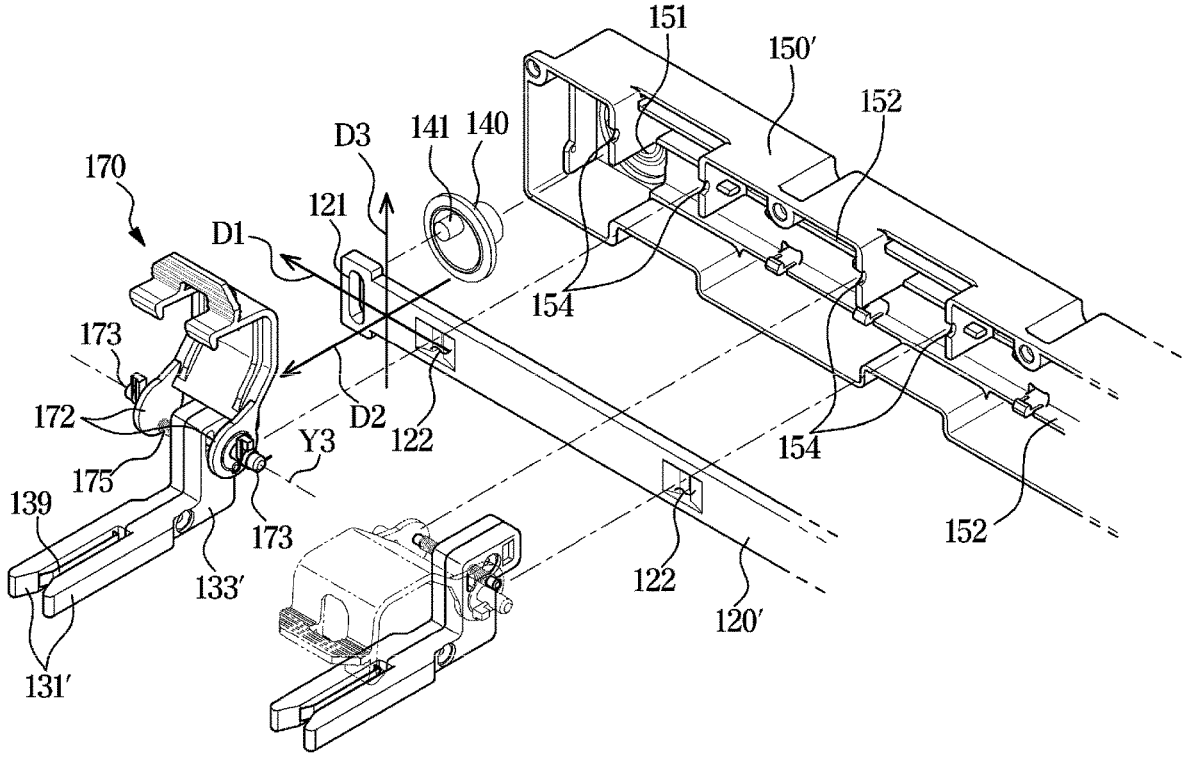
FIG. 18 is an exploded view of the clothes hanger illustrated in FIG. 17 according to an embodiment of the present invention.
Figure 19:
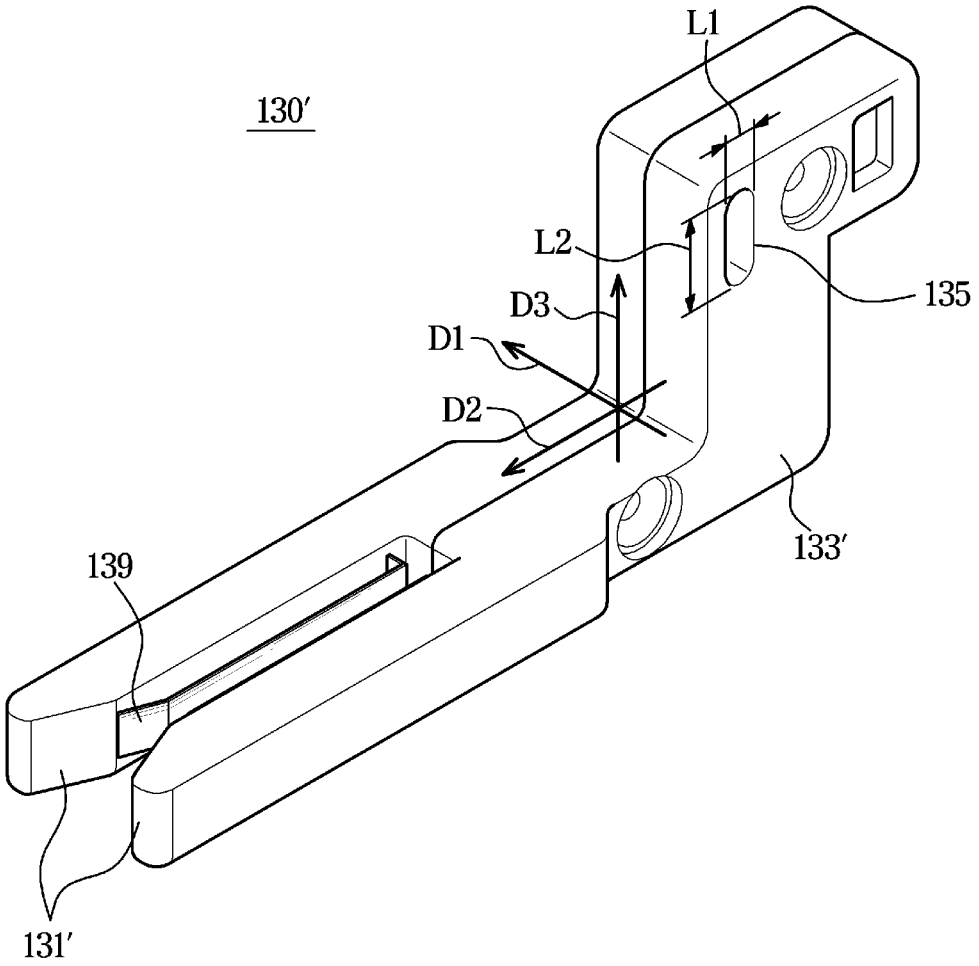
FIG. 19 is a perspective view of a swing hook of a clothes hanger included in the clothes care apparatus according to another embodiment of the present invention.
Figure 20:
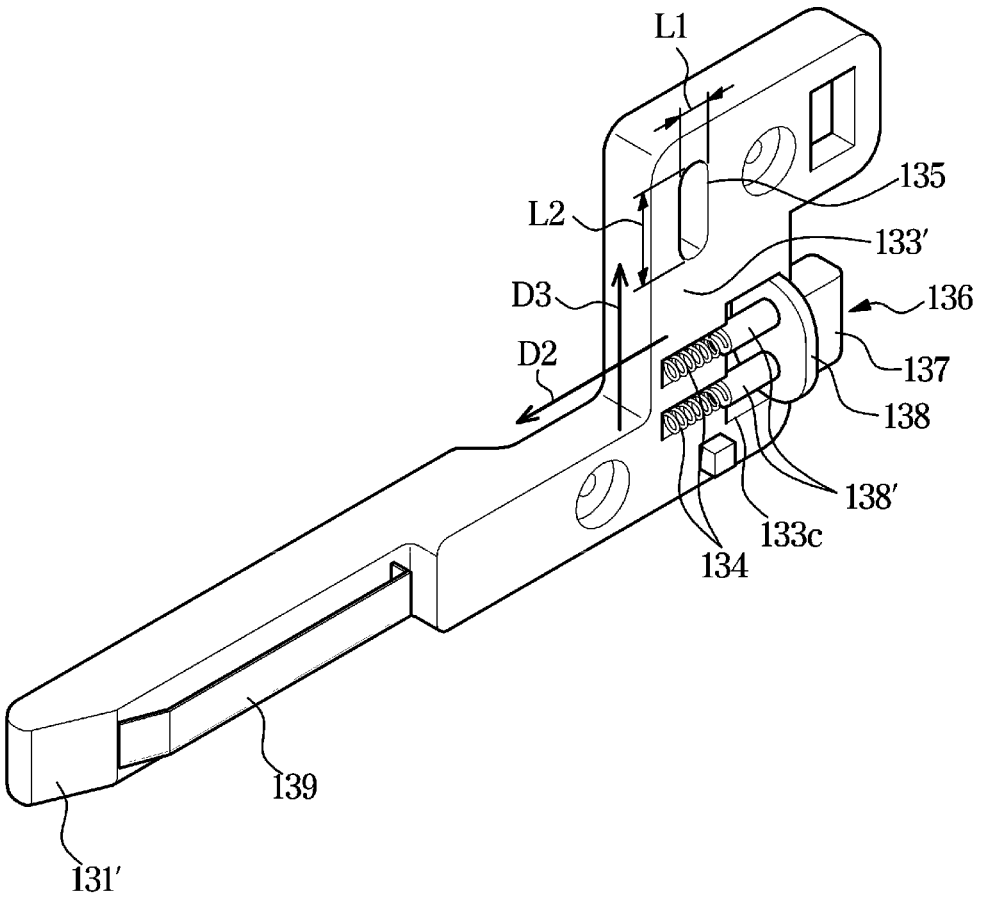
FIG. 20 is a perspective view in which one of a pair of pressing parts of FIG. 19 is removed according to an embodiment of the present invention.
Figure 21:
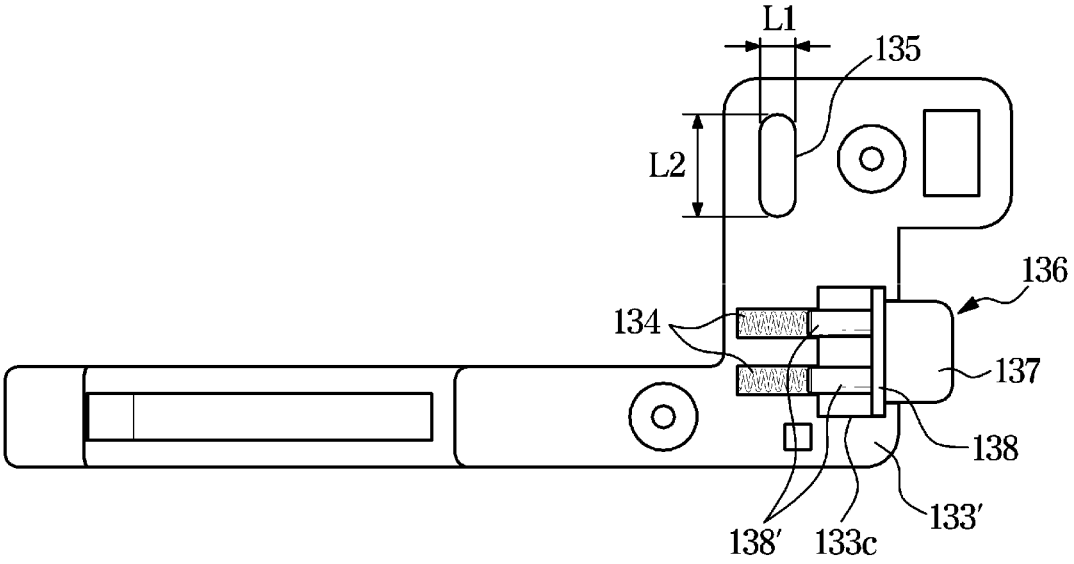
FIG. 21 is a side view in which one of the pair of pressing parts of FIG. 19 is removed according to an embodiment of the present invention.
Figure 22:
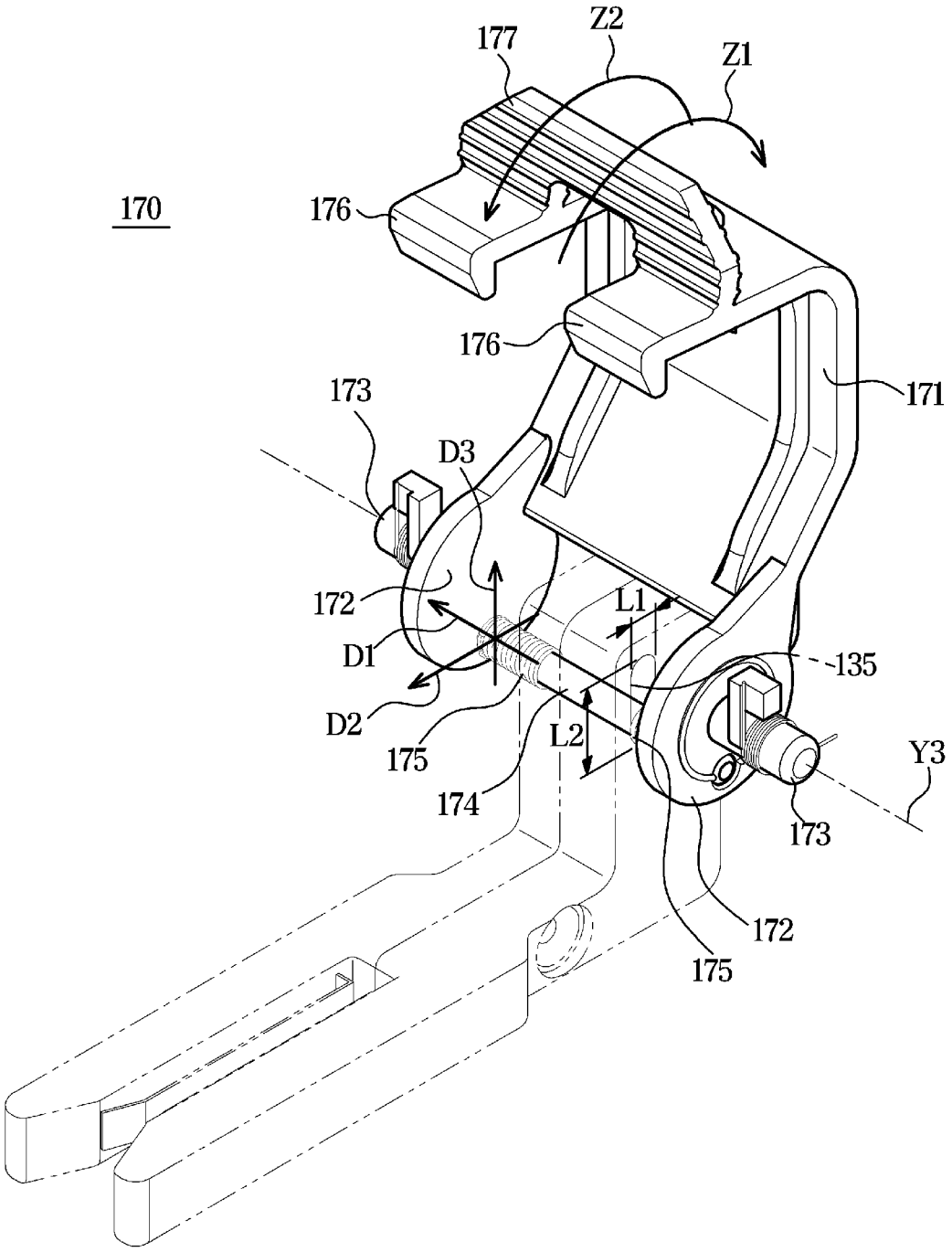
FIG. 22 is a perspective view of a cover link of the clothes hanger included in the clothes care apparatus according to another embodiment of the present invention.
Figure 23:
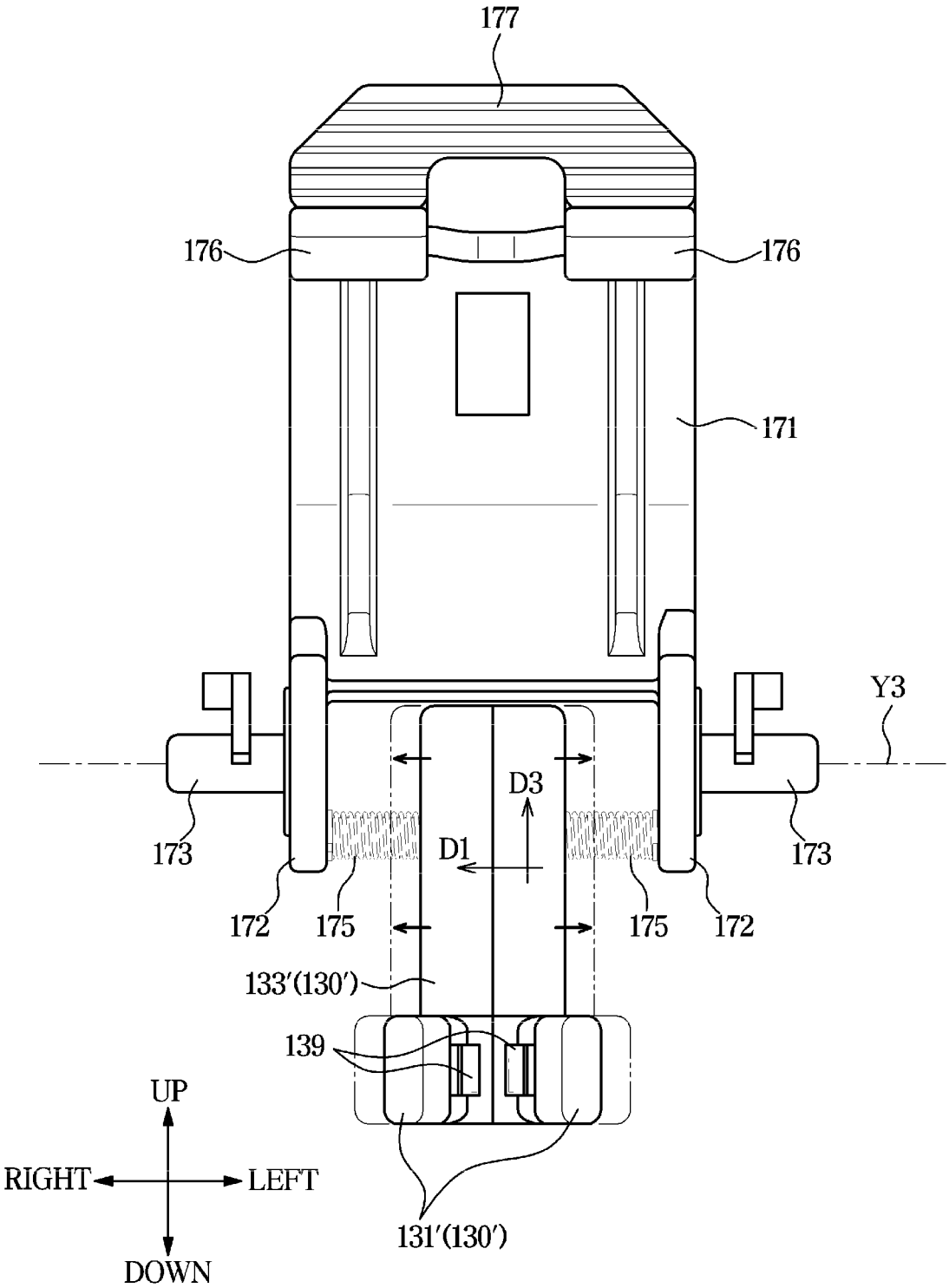
FIG. 23 is a front view of a swing hook and a swing hook of the clothes hanger included in the clothes care apparatus according to another embodiment of the present invention.
Figure 24:
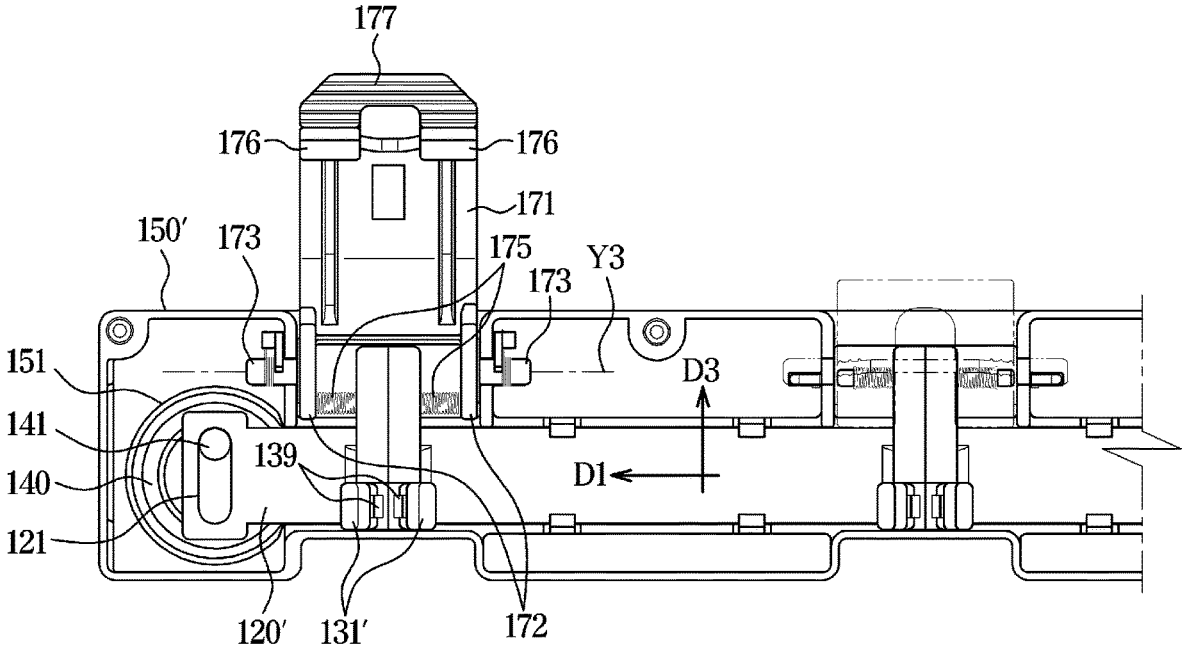
FIG. 24 is a view in which a support bar, a support portion, and a hanger cover in FIG. 15 are removed according to an embodiment of the present invention.

FIG. 16 is a perspective view of the portion of the clothes hanger illustrated in FIG. 13. FIG. 17 is a perspective view in which the hanger cover is removed from the clothes hanger of FIG. 16. FIG. 18 is an exploded view of the clothes hanger illustrated in FIG. 17. FIG. 19 is a perspective view of a swing hook of the clothes hanger included in the clothes care apparatus according to another embodiment of the present invention. FIG. 20 is a perspective view in which one of the pair of pressing parts of FIG. 19 is removed. FIG. 21 is a side view in which one of the pair of pressing parts of FIG. 19 is removed. FIG. 22 is a perspective view of the cover link of the clothes hanger included in the clothes care apparatus according to another embodiment of the present invention. FIG. 23 is a front view of the swing hook, and the swing hook of the clothes hanger included in the clothes care apparatus according to another embodiment of the present invention. FIG. 24 is a view in which the support bar, the support portion, and the hanger cover in FIG. 15 are removed.

The clothes hanger 100' may further include the sliding base 150' provided to support the slider 120', a motor (not shown) providing a driving force for reciprocating motion of the slider 120' and an interlocking portion 140 for transmitting a rotational force of the motor (not shown) to the slider 120', and a hanger cover 160 including a cover hole 161 so that the swing hook 130' protrudes into the care chamber 30, and since specific structures of the above components are the same as those described above, no redundant description will be provided, and only different configurations from those described above will be mainly described.

The swing hook 130' may be selectively connected to the slider 120' according to a rotation direction of the cover link 170. Therefore, unlike the swing hook 130 according to one embodiment of the present invention, the swing hook 130' according to another embodiment of the present invention may be provided to be detachable from the slider 120'.

In order for the swing hook 130' to be selectively connected to the slider 120', the swing hook 130' may include a coupling protrusion 136 and the slider 120' may include a coupling groove 122.

The coupling protrusion 136 may protrude in an opposite direction to the pair of pressing parts 131'. The pair of pressing parts 131' may extend in a second direction D2 intersecting the support bar 110. The coupling protrusion 136 may protrude in a direction opposite to the second direction D2.

The coupling protrusion 136 may include a protruding head 137 inserted into the coupling groove 122, a guide plate 138 to which the protruding head 137 is fixed and that is formed to correspond to an end surface of a guide chamber 133C, and a guide cylinder 138' to which the guide spring 134 is connected.

The swing hook 130' may further include the guide chamber 133C that is formed in a body of the swing hook 130' and into which the coupling protrusion 136 is slidably inserted, and a guide spring 134 provided to press the coupling protrusion 136 in the direction opposite to the second direction D2.

The guide chamber 133C may be formed at a bent portion 133 of the swing hook 130'. The guide chamber 133C may include a chamber opening 133*a* that opens in the direction opposite to the second direction D2. The protruding head 137 of the coupling protrusion 136 may protrude toward the slider 120' through the chamber opening 133*a*. The protruding head 137 of the coupling protrusion 136 may protrude in the direction opposite to the second direction D2 through the chamber opening 133*a*.

The guide plate 138 of the coupling protrusion 136 may be formed to be wider than a cross-sectional area of the chamber opening 133*a*. The guide plate 138 may be provided to slide while being supported on an inner wall of the guide chamber 133C inside the guide chamber 133C and the movement of the guide plate 138 may be limited by the chamber opening 133*a*, thereby preventing the coupling protrusion 136 from completely escaping from the swing hook 130'. An edge of the guide plate 138 may be provided in a shape corresponding to the cross section of the guide chamber 133C.

The coupling protrusion 136 may include the guide cylinder 138' protruding from the guide plate 138 toward the second direction D2. The guide cylinder 138' may be connected to a guide spring 134 fixed inside a body of the swing hook 130'. A diameter of the guide cylinder 138' may be provided to correspond to a diameter of the cylinder-shaped guide spring 134. The guide cylinder 138' may be provided to press the coupling protrusion 136 in the direction opposite to the second direction D2.

The swing hook 130' may further include a link slit 135 passing through the body of the swing hook 130' to be connected to the cover link 170. The link slit 135 will be described below in detail.

Referring to FIGS. 22 and 23, the cover link 170 may further include link axial protrusions 173 supported by a link body 171 and a sliding base 150', and a link rod 174 connecting the cover link 170 and the swing hook 130'.

The body of the cover link 170 may be provided in a substantially hook shape as described above. The fixing hook 176 may be provided at one end of the hook shape, and a pair of link plates 172 facing each other may be provided at the other end of the hook shape. The link plate 172 may be provided in a substantially circular shape.

The cover link 170 may include a pair of link axial protrusions 173 supported by the sliding base 150'. The pair of link axial protrusions 173 may be located on a rotation axis Y3 of the cover link and may protrude from both sides of the link body 171. Specifically, the pair of link axial protrusions 173 may respectively protrude from the centers of the pair of link plates 172 toward both sides of the cover link 170. The pair of link axial protrusions 173 may be supported by cover link support portions 154 of the sliding base 150' (see FIG. 18).

The link rod 174 may be disposed between the pair of link axial protrusions 173. That is, the link rod 174 may be disposed between the pair of link plates 172. The link rod 174 may be fixed to the pair of link plates 172. The link rod 174 may be provided in a thin bar shape. The link rod 174 may be spaced apart from the rotation axis Y3 of the cover link 170 and may extend in parallel with the rotation axis Y3 of the cover link 170. The link rod 174 may be fixed to the lower end of the pair of link plates 172 in the first state S10. Therefore, the link rod 174 may be provided to, as the cover link 170 rotates in the second direction Z2, move in the opposite direction to the second direction D2 and simultaneously in the third direction D3 perpendicular to the first direction D1 and the second direction D2 and directed upward. The link rod 174 may be inserted into the link slit 135.

As described above, the swing hook 130' may further include a link slit 135 passing through the body of the swing hook 130' to be connected to the cover link 170. The link slit 135 may be formed in a direction parallel to the third direction. A width L1 of the link slit 135 may correspond to a diameter of the link rod 174. Since the width L1 of the link slit 135 corresponds to the diameter of the link rod 174, inside the link slit 135, the motion of the link rod 174 relative to the link slit 135 may be limited in a direction parallel to the second direction D2.

A height L2 of the link slit 135 may correspond to a magnitude of a displacement of the link rod 174 between its lowermost position in the first state S10 and its uppermost position in the second state S20 in the third direction D3.

The link rod 174 may be provided to, as the cover link 170 rotates in the second direction Z2, move in the opposite direction to the second direction D2 and simultaneously in the third direction D3 perpendicular to the first direction D1 and the second direction D2 and directed upward. The link rod 174 may move only in the direction parallel to the third direction D3 inside the link slit 135.

Therefore, even if the cover link 170 rotates in the second direction Z2, the swing hook 130' may move in the opposite direction to the second direction D2, and may not move in the third direction D3. Likewise, even if the cover link 170 rotates in the first direction Z1, the swing hook 130' may move in the second direction D2, and may not move in the third direction D3.

Referring to FIGS. 22 and 23, the cover link 170 may further include a pair of swing springs 175 disposed at both ends of the link slits 135 while surrounding the link rod 174. A diameter of the pair of swing springs 175 may be greater than the width L1 of the link slit 135. Both ends of each of the pair of swing springs 175 may be supported by the link slit 135 and the pair of link plates 172. The pair of swing springs 175 may press the body of the swing hook so that the swing hook is positioned at the center of the link rod 174.

Figure 25:
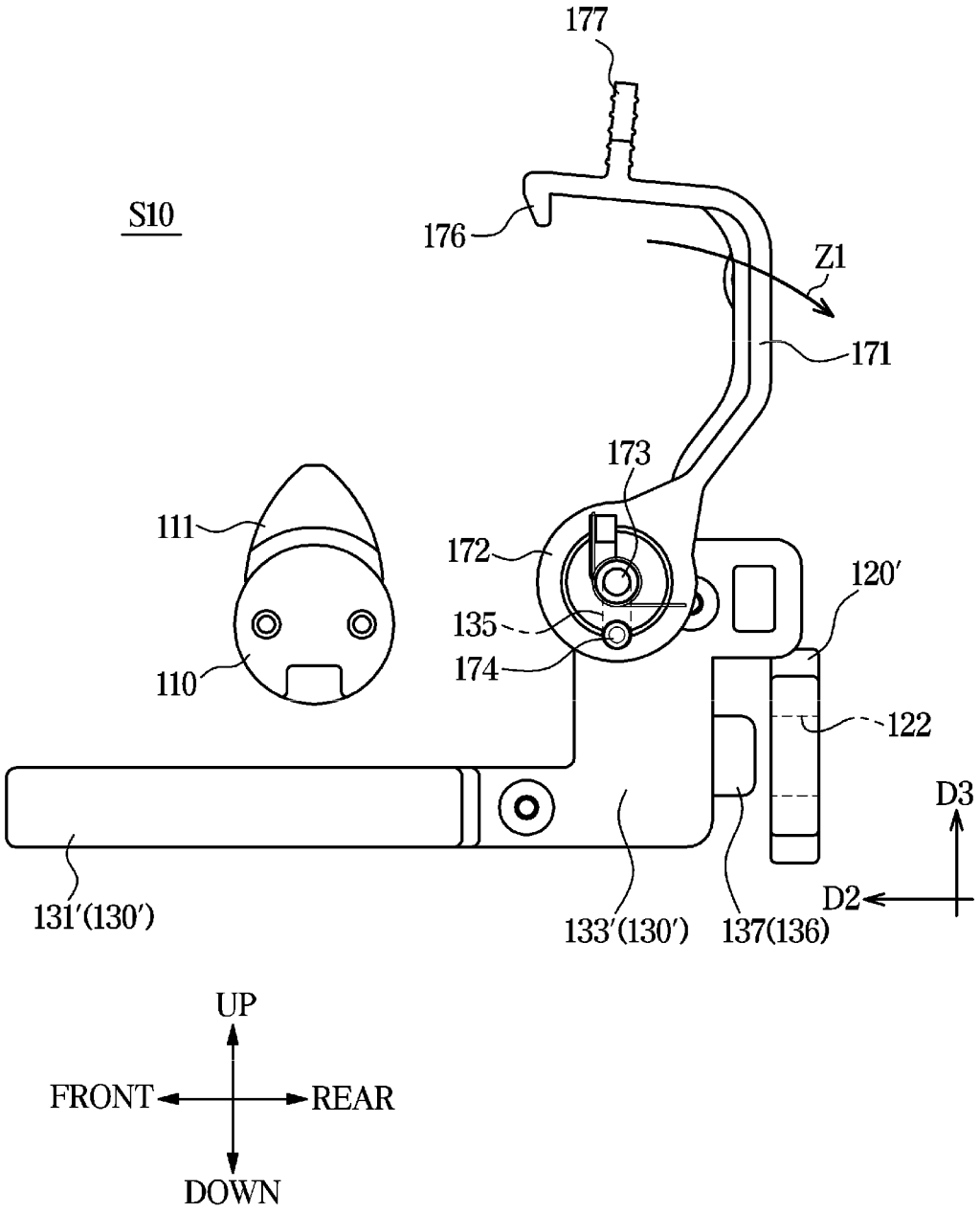
FIG. 25 is a side view of the cover link, the swing hook, and the support bar in a first state according to an embodiment of the present invention.
Figure 26:
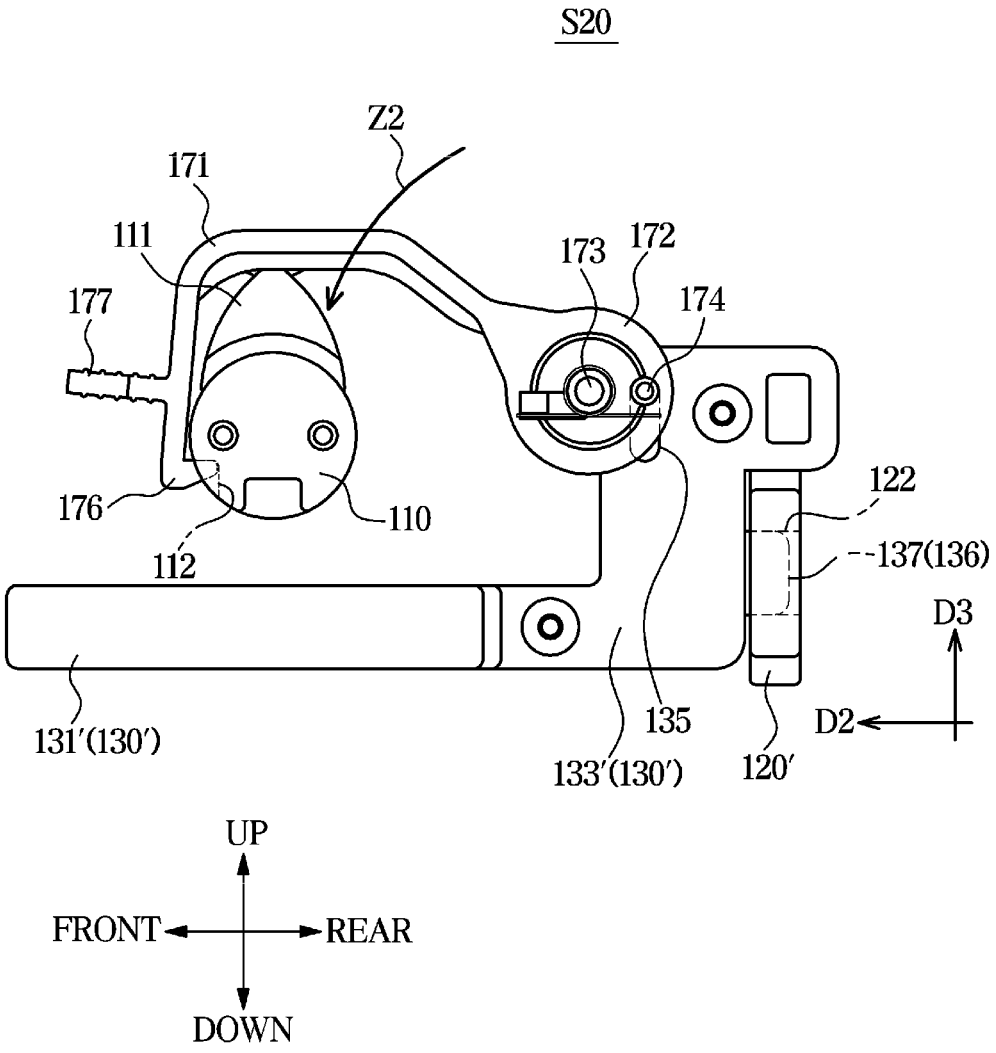
FIG. 26 is a side view of the cover link, the swing hook, and the support bar in a second state according to an embodiment of the present invention.
Figure 27:
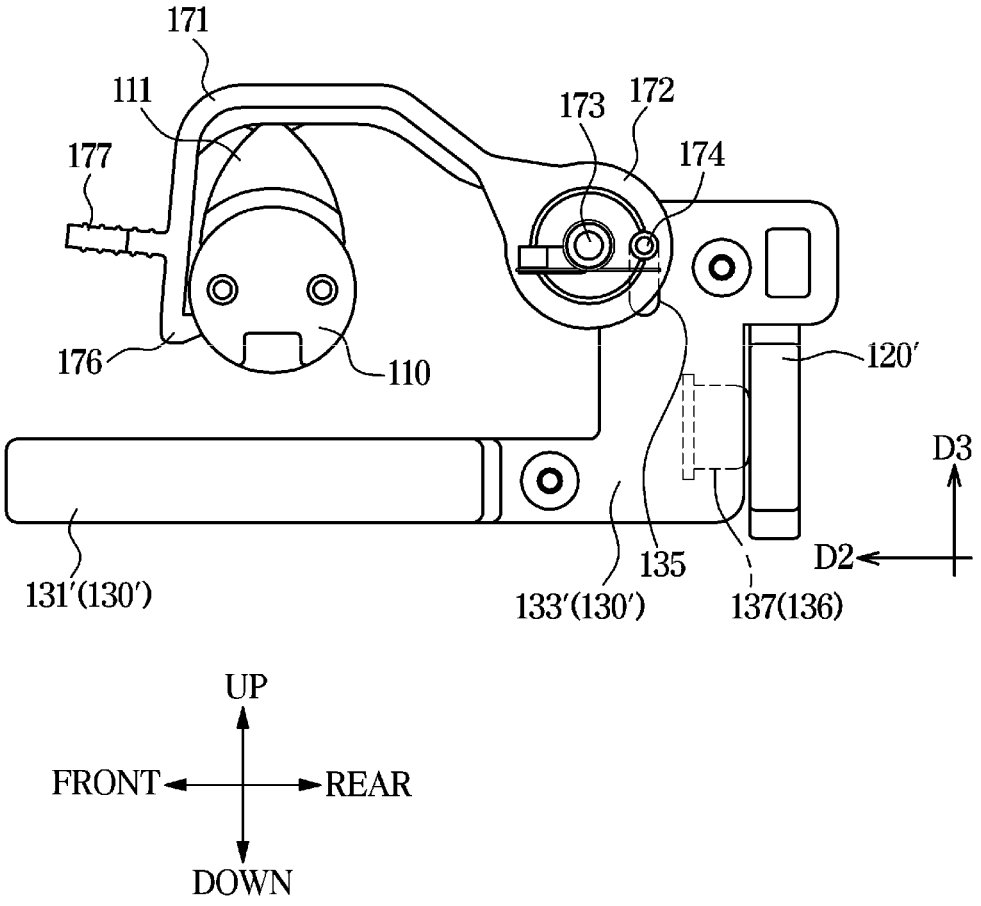
FIG. 27 is a side view illustrating a state in which a coupling protrusion of the swing hook is not connected to a coupling groove of a slider in a state in which the cover link is fixed to the support bar according to an embodiment of the present invention.

FIG. 25 is a side view of the cover link, the swing hook, and the support bar in the first state. FIG. 26 is a side view of the cover link, the swing hook, and the support bar in the second state. FIG. 27 is a side view illustrating a state in which a coupling protrusion of the swing hook is not connected to a coupling groove of the slider in a state in which the cover link is fixed to the support bar.

Hereinafter, a structure for performing a selective connection between the swing hook 130' and the slider 120' according to the rotation direction of the cover link 170 will be described.

Referring to FIG. 25, the cover link 170 may be provided in the first state S10 in which the swing hook 130' is disconnected from the slider 120' by rotating in the first rotation direction Z1. The link rod 174 may be provided to be fixed to a lower end of the pair of link plates 172 in the first state S10 and may be provided to be positioned at a lowermost end of the link slit 135. Since the first state S10 is a state in which the coupling protrusion 136 of the swing hook 130' is not inserted into the coupling groove 122 of the slider 120', the slider 120' and the swing hook 130' may remain disconnected. Therefore, even when the slider 120' performs the reciprocating motion, the swing hook 130' may maintain its position.

Referring to FIG. 26, the cover link 170 may be provided in the second state S20 in which the swing hook 130' is connected to the slider 120' by rotating in the second rotation direction Z2.

When the cover link 170 rotates in the second rotation direction Z2, the link rod 174 moves in the second direction D2 and the third direction D3. Specifically, the link rod 174 may be provided to, as the cover link 170 rotates in the second direction Z2, move in the opposite direction to the second direction D2 and simultaneously in the third direction D3 perpendicular to the first direction D1 and the second direction D2 and directed upward.

As described above, the height L2 of the link slit 135 corresponds to the magnitude of the displacement of the link rod 174 between its lowermost position in the first state S10 and its uppermost position in the second state S20 in the third direction D3. Therefore, even if the cover link 170 rotates in the second direction Z2, the swing hook 130' may move in the opposite direction to the second direction D2, and may not move in the third direction D3.

As the swing hook 130' moves in the opposite direction to the second direction D2, the coupling protrusion 136 may be inserted into the coupling groove 122. Therefore, the swing hook 130' and the slider 120' may be connected, and the subsequent reciprocating motion process of the swing hook 130' and the slider 120' may proceed in the same manner as described in FIG. 12.

Referring to FIG. 27, even if the swing hook 130' moves in an opposite direction to the second direction D2, the coupling protrusion 136 may not be inserted into the coupling groove 122 according to the position of the slider 120'. However, the coupling protrusion 136 may be provided in a structure in which the coupling protrusion 136 is able to slide inside the slide chamber 133C, and may be pressed in a direction in which the coupling protrusion 136 is inserted into the coupling groove 122 by the guide spring 134 at a specific moment when the coupling groove is positioned at a position corresponding to that of the coupling protrusion 136 while the slider 120' is performing the reciprocating motion. Accordingly, the second state S20 shown in FIG. 26 may be reached. Since the swing hook 130' and the slider 120' are connected, a subsequent reciprocating motion process of the swing hook 130' and the slider 120' may proceed in the same manner as described in FIG. 12.

In the above, specific embodiments have been illustrated and described. However, the present invention is not limited to the above-described embodiments, and it will be apparent to those skilled in the art that various modifications and variations can be made in the present invention without departing from the technical spirit of the present invention defined in the claims.

What is claimed is:

1. A clothes care apparatus comprising:

a care chamber to accommodate clothes;

a support bar to extend along an extending direction inside the care chamber;

a holding member on which the clothes are to be hung, the holding member including a hanging portion, at an upper end of the holding member, that is supportable by the support bar;

a support portion, arrangeable relative to the support bar, such that while an upper end of the hanging portion is hung on the support portion, the hanging portion is supported by the support bar;

a slider to perform a linear reciprocating motion; and a swing hook, to grip a lower end of the hanging portion, and coupleable to the slider such that while the swing hook is coupled to the slider, the swing hook is moveable while the slider performs the linear reciprocating motion, wherein the upper end of the hanging portion is supported by the support portion along a first direction of the care chamber while the lower end of the hanging portion reciprocates along a second direction of the care chamber different from the first direction as the swing hook moves while the slider performs the linear reciprocating motion, thereby the hanging portion is to shake the clothes hung on the holding member.

2. The clothes care apparatus of claim 1, wherein the slider is in a bar shape extending parallel to a first direction and performs the linear reciprocating motion parallel to the first direction, and the slider includes an interlocking slit, through the slider, the interlocking slit being along an extending direction formed parallel to a third direction perpendicular to the first direction in which the slider performs the linear reciprocating motion.

3. The clothes care apparatus of claim 2, further comprising a sliding base coupleable to the care chamber and including a slider guide to support both ends of an edge of the slider so that the slider performs the linear reciprocating motion along the first direction.

4. The clothes care apparatus of claim 2, further comprising:

a motor configured to provide a driving force to the slider and an interlocking portion connectable to a rotation axis of the motor to rotate, wherein the interlocking portion includes an interlocking protrusion formed at a position spaced apart from a rotation center of the interlocking portion, and the interlocking protrusion is insertable into the interlocking slit to convert a rotational motion of the motor into the linear reciprocating motion of the slider.

5. The clothes care apparatus of claim 4, further comprising:

a sliding base, coupleable to the care chamber, the sliding base including a first surface on which the slider is to be seated and a second surface that is positioned opposite to the first surface and to which the motor is coupleable, wherein the sliding base includes:

a slider guide, protruding from the first surface, to support both ends of an edge of the slider so that the slider performs the linear reciprocating motion along the first direction; and an interlocking hole in which the interlocking portion is rotatably seated, the interlocking hole being through the sliding base so that the first surface and the second surface are connected.

6. The clothes care apparatus of claim 1, wherein the hanging portion is in a hook shape, the lower end of the hanging portion extends from the upper end of the holding member, and the upper end of the hanging portion is positionable at an upper portion of the hook shape, and the support portion includes a seating part by which the upper end of the hanging portion is supported and limiting parts disposed at both ends of the seating part and provided to limit movement of the upper end of the hanging portion in the extending direction of the support bar.

7. The clothes care apparatus of claim 6, wherein the swing hook is among a plurality of swing hooks, the plurality of swing hooks coupleable to the slider at regular intervals, and a plurality of support portions are provided to correspond to the plurality of swing hooks.

8. The clothes care apparatus of claim 1, wherein the slider performs the linear reciprocating motion in a first direction which is parallel to the extending direction of the support bar.

9. The clothes care apparatus of claim 1, wherein the slider performs the linear reciprocating motion along a first direction, the swing hook includes a pair of pressing parts extending along a second direction perpendicular to the extending direction in which the support bar extends, and the lower end of the hanging portion is between the pair of pressing parts of the swing hook.

10. The clothes care apparatus of claim 9, wherein the extending direction of the support bar and the second direction are perpendicular to each other.

11. A clothes care apparatus comprising:

a care chamber to accommodate clothes;

a support bar to extend along an extending direction inside the care chamber;

a holding member on which the clothes are to be hung, the holding member including a hanging portion, at an upper end of the holding member, that is supportable by the support bar;

a support portion arrangeable relative to the support bar such that while an upper end of the hanging portion is hung on the support portion the hanging portion is supported by the support bar;

a slider to perform a linear reciprocating motion;

a swing hook, to grip a lower end of the hanging portion, and coupleable to the slider such that while the swing hook is coupled to the slider, the swing hook is moveable while the slider performs the linear reciprocating motion; and a cover link, which is rotatable, provided on a sliding base supporting the slider, wherein the swing hook is selectively connectable to the slider according to a rotation direction of the cover link.

12. The clothes care apparatus of claim 11, wherein the slider performs the linear reciprocating motion along a first direction, and the swing hook includes:

a pair of pressing parts, extending along a second direction perpendicular to the extending direction in which the support bar extends, and the lower end of the hanging portion being disposed between the pair of pressing parts, and a coupling protrusion protruding in an opposite direction to the second direction, wherein the slider includes a coupling groove formed to correspond to the coupling protrusion.

13. The clothes care apparatus of claim 12, wherein the swing hook further includes:

a guide chamber formed in a body of the swing hook and into which the coupling protrusion is slidably inserted and a guide spring disposed in the guide chamber to press the coupling protrusion in the opposite direction to the second direction.

14. The clothes care apparatus of claim 12, wherein the cover link includes:

a link body;

a pair of link axial protrusions supportable by the sliding base, positioned on a rotation axis of the cover link, and protruding from both sides of the link body; and a link rod between the pair of link axial protrusions, spaced apart from the rotation axis of the cover link, and extending in parallel with the rotation axis of the cover link, wherein the swing hook includes a link slit through the swing hook, and an extending direction of the link slit is perpendicular to an extending direction of the link rod, and wherein the link rod is insertable into the link slit to selectively connect the swing hook to the slider along the second direction perpendicular to the first direction according to the rotation direction of the cover link.

15. The clothes care apparatus of claim 14, wherein the cover link further includes a pair of swing springs surrounding the link rod and at both ends of the link slit, and the pair of swing springs press a body of the swing hook so that the swing hook is positioned at a center of the link rod.

* * * * *